US005923310A

United States Patent [19]

Kim

[11] Patent Number: 5,923,310

[45] Date of Patent: Jul. 13, 1999

[54] LIQUID CRYSTAL DISPLAY DEVICES WITH INCREASED VIEWING ANGLE CAPABILITY AND METHODS OF OPERATING SAME

[75] Inventor: Dong-gyu Kim, Kyungki-do, Rep. of Korea

[73] Assignee: Samsung Electronics Co., Ltd., Suwon, Rep. of Korea

[21] Appl. No.: 08/786,474

[22] Filed: Jan. 20, 1997

[30] Foreign Application Priority Data

Jan. 19, 1996 [KR] Rep. of Korea ..... 96-1098
Jan. 17, 1997 [KR] Rep. of Korea ..... 97-1318

[51] Int. Cl.[6] ..... G09G 3/36

[52] U.S. Cl. ..... 345/90; 345/94

[58] Field of Search ..... 345/90–96, 205–206, 345/208–210, 100, 87, 98, 99

[56] References Cited

U.S. PATENT DOCUMENTS

| | | | |
|---|---|---|---|
| 4,928,095 | 5/1990 | Kawahara | 345/93 |
| 5,050,965 | 9/1991 | Conner et al. | 359/53 |
| 5,124,818 | 6/1992 | Conner et al. | 359/53 |
| 5,247,289 | 9/1993 | Matsueda | 345/98 |
| 5,384,065 | 1/1995 | Geelhaar et al. | 252/299.63 |
| 5,392,141 | 2/1995 | Jang | 359/53 |
| 5,399,889 | 3/1995 | Miyake et al. | 257/292 |
| 5,414,545 | 5/1995 | Lee | 359/53 |
| 5,418,633 | 5/1995 | Kim et al. | 359/53 |
| 5,473,450 | 12/1995 | Yamada et al. | 359/51 |
| 5,484,627 | 1/1996 | Jang et al. | 427/58 |
| 5,517,341 | 5/1996 | Kim et al. | 359/59 |
| 5,517,342 | 5/1996 | Kim et al. | 359/59 |
| 5,526,012 | 6/1996 | Shibahara | 345/539 |
| 5,568,163 | 10/1996 | Okumura | 345/100 |
| 5,576,857 | 11/1996 | Takemura | 345/92 |
| 5,576,862 | 11/1996 | Sugiyama et al. | 359/75 |
| 5,724,059 | 3/1998 | Kanbe et al. | 345/94 |
| 5,731,796 | 3/1998 | Furuhashi et al. | 345/98 |

*Primary Examiner*—Xiao Wu
*Attorney, Agent, or Firm*—Myers Bigel Sibley & Sajovec

[57] ABSTRACT

Liquid crystal display devices with increased viewing angle capability include a plurality of configurable liquid crystal sub-pixels which form each pixel image in the display. The voltages appearing across the liquid crystal capacitors in each sub-pixel representing a pixel image (i.e., $V_{LC}$) are preferably set to different values by connecting the storage capacitor in each sub-pixel (i.e., liquid crystal display cell) to a gate line (or control line) which is different from the gate line connected to the sub-pixel's switching device (e.g., thin-film transistor TFT) and also by designing the storage capacitors in each sub-pixel to have different capacitance values. By establishing different voltages across the liquid crystal capacitors in each sub-pixel within a pixel image, the maximum viewing angle of a liquid crystal display device formed thereby can be improved because each sub-pixel element within a pixel image can be set to have a different transmittivity.

19 Claims, 23 Drawing Sheets

LIQUID CRYSTAL DISPLAY DEVICES WITH INCREASED VIEWING ANGLE CAPABILITY AND METHODS OF OPERATING SAME

FIELD OF THE INVENTION

The present invention relates to display devices and methods of operating display devices, and more particularly to liquid crystal display devices and methods of operating liquid crystal display devices.

BACKGROUND OF THE INVENTION

A thin film transistor liquid crystal display (TFT LCD) uses a thin film transistor as a switching device and the electrical-optical effect of liquid crystal molecules to display data visually. A display is typically composed of a TFT substrate in which a plurality of liquid crystal pixels having a TFT and a pixel electrode are formed, a substrate where a common electrode is formed, and liquid crystal material sealed therebetween, as will be understood by those skilled in the art.

Methods for achieving gray scale representation in TFT LCDs have been achieved based on the electrical-optical response curve of the liquid crystal material. The contrast ratio of TFT LCDs vary in accordance with the viewing angle. Also, a viewing angle dependence of the contrast ratio is varied regarding optical transmission. This dependance of the viewing angle is significant in a twisted nematic type of LCD as will be understood by those skilled in the art. As a result, gray scale errors can be introduced when TFT LCDs are viewed off-normal. This gray scale error increases with increases in the viewing angle, to thereby limit the allowable maximum viewing angle. Also, the dependence of the angle of viewing on the characteristics of the liquid crystal display is typically more severe in a vertical direction than in a horizontal direction.

Much work has been done for improving the viewing angle characteristics of TFT LCDs. For example, a TN cell using optical compensation films, a TN cell using subpixels, and a multi-domain TN cell have been proposed. However, since characteristics of asymmetrical visibility and gradation inversion remain, the optical compensation method using an optical compensation film has little effect in enhancing the angle of the viewing. The multi-domain TN cell, such as a dual-domain TN cell, requires an increase in the number of fabrication steps because it requires a plurality of photolithography processes and a plurality of rubbing processes. However, these additional steps can cause a reduction in yield. The TN cell using subpixels causes the problems that the open area ratio of the pixel is lowered and the number of fabrication steps therefor is increased.

FIGS. 1–3 show various dual-domain TN cells. A complementary TN cell structure shown in FIG. 1 has an alignment layer having a low pre-tilt angle formed on an upper substrate and an alignment layer having a high pre-tilt angle formed on a lower substrate, respectively. In addition, the alignment layer formed on the lower substrate has a different direction of alignment by domains. Referring to FIG. 2, a polyimide film is formed on the lower substrate and undergoes a rubbing process in a first alignment direction. Then, a photoresist pattern is formed. This pattern is for dividing the cell into two domains. Then, another rubbing process is performed in a second alignment direction which is opposite to the first alignment direction. Thus, the part under the photoresist pattern doesn't undergo the second rubbing process, while the remnant part undergoes the second rubbing process. Subsequently, the photoresist pattern is removed.

In a TN cell structure shown in FIG. 3, two different alignment layers are sequentially formed on both upper and lower substrates. Here, the first alignment layers have low pre-tilt angle and the second alignment layers have high pre-tilt angle. The second alignment layers are also patterned by a photolithography method and may be made of an inorganic material. Thus, the rubbing process for the second alignment layer of high pre-tilt angle doesn't affect the first alignment layer.

FIGS. 4A, 4B and 5 show the conventional TN cell using subpixels. Referring to FIG. 4A, a liquid crystal pixel is divided into a plurality of sub-pixels, i.e., sub-pixel 1, sub-pixel 2 and sub-pixel 3, with the sub-pixels each having different liquid crystal capacitances $C_{LC1}$, $C_{LC2}$ and $C_{LC3}$, respectively. FIG. 4B shows the equivalent circuit of FIG. 4A. Each cell also has two different control capacitors $C_{C2}$ and $C_{C3}$. The control capacitors $C_{C2}$ and $C_{C3}$ of the cell, which are selectively connected to three liquid crystal capacitors $C_{LC1}$, $C_{LC2}$ and $C_{LC3}$, serve as a voltage divider and supply a control voltage to each of the sub-pixels. Accordingly, even though the voltage applied through a TFT to the pixel electrode is one value, different voltages are applied to the sub-pixel liquid crystal capacitors $C_{LC1}$, $C_{LC2}$ and $C_{LC3}$. That is, the voltages applied to the sub-pixels are different.

Thus, the twist angles of the liquid crystal corresponding to the sub-pixels are different. As a result, one liquid crystal cell is composed of three sub-pixels having three kinds of different transmittivities. Here, the transmittivity of a liquid crystal cell is an average value of the three kinds of transmittivities. Since the viewing angle dependence is different according to the transmittivities, the device shown in FIG. 4A can be viewed at relatively large viewing angles.

Referring to FIG. 5, reference numeral 10 indicates a lower substrate formed of glass, reference numeral 12 indicates a gate electrode, reference numeral 14 indicates a gate insulating film, reference numeral 16 indicates a pixel electrode, reference numeral 18 indicates a transparent insulating film and reference character TFT indicates a thin-film switching transistor.

In FIG. 5, three sub-pixel liquid crystal capacitors $C_{LC1}$, $C_{LC2}$ and $C_{LC3}$ represent equivalent capacitances formed in the combination of a common electrode of the upper substrate with electrode layers 16, 16' and 16", respectively. That is, in order to cover the part of the pixel electrode 16, a first transparent insulating layer 18 and a first transparent electrode 16' are formed, and then a second insulating layer 18' and a second transparent electrode 16" are sequentially formed thereon.

However, in order to form the sub-pixel liquid crystal capacitors, the additional steps of stacking transparent insulating layers and patterning the transparent electrodes must be performed. Thus, this device has a low open area ratio and the additional fabrication steps typically lead to a reduction in the yield of the TFT LCD.

SUMMARY OF THE INVENTION

It is therefore an object of the present invention to provide improved liquid crystal display (LCD) devices and methods of operating same.

It is another object of the present invention to provide liquid crystal display devices having large maximum viewing angles and methods of operating same.

It is still another object of the present invention to provide liquid crystal display devices which can be fabricated using conventional display fabrication methods.

These and other objects, advantages and features of the present invention are provided by liquid crystal display devices which use a plurality of configurable liquid crystal sub-pixels to form each pixel image therein. In particular, the voltages appearing across the liquid crystal capacitors in each sub-pixel representing a pixel image (i.e., $V_{LC}$) are preferably set to different values by connecting the storage capacitor in each sub-pixel (i.e., liquid crystal display cell) to a gate line (or control line) which is different from the gate line connected to the sub-pixel's switching device (e.g., thin-film transistor TFT) and also by designing the storage capacitors in each sub-pixel to have different capacitance values. By establishing different voltages across the liquid crystal capacitors in each sub-pixel within a pixel image, the maximum viewing angle of a liquid crystal display device formed thereby can be improved because each sub-pixel element within a pixel image can be set to have a different transmittivity.

According to one embodiment of the present invention, a liquid crystal display device is provided having a first row of liquid crystal display cells (e.g., LCD TFT cells) with data inputs electrically connected to a plurality of data lines and gates commonly connected to a first gate line and a second row of liquid crystal display cells with data inputs electrically connected to the plurality of data lines and gates commonly connected to a second gate line. To achieve the above described advantages of increased viewing angle, the storage capacitors in the second row of liquid crystal display cells have electrodes electrically connected to the first gate line so that while display data is being loaded into the second row of display cells (upon application of a turn-on bias to the second gate line), the first gate line can be set to a predetermined potential. Based on capacitive coupling between the first gate line and the pixel electrodes of the display cells in the second row, the voltages appearing across the liquid crystal capacitors in the display cells in the second row can be set to preferred levels based on the data loaded therein.

Furthermore, the storage capacitors in a third row of liquid crystal display cells have electrodes electrically connected to the second gate line so that while duplicate display data is being loaded into the third row of display cells (upon application of a turn-on bias to a third gate line), the second gate line can be set to a predetermined potential. Based on capacitive coupling between the second gate line and the pixel electrodes of the display cells in the third row, the voltages appearing across the liquid crystal capacitors in the display cells in the third row can be set to preferred levels which are different from the preferred levels established for the second row of display cells. These differences in voltage levels appearing across the liquid crystal capacitors in each row of cells result in the establishment of different transmittivities for the respective upper and lower cells (e.g., sub-pixels) in adjacent rows. These different transmittivities can then be utilized to improve the display's maximum viewing angle.

According to another embodiment of the present invention, a liquid crystal display device is provided having a plurality of groups of liquid crystal display cells (e.g., LCD TFT cells). To achieve the above described advantages of increased viewing angle, the storage capacitors in a first group of cells have electrodes electrically connected to a first control line (e.g., S1) so that while display data is being loaded into the first group of cells, the first control line can be set to a predetermined potential. Based on capacitive coupling between the first control line and the pixel electrodes of the display cells in the first group, the voltages appearing across the liquid crystal capacitors in the first group of cells can be independently set to preferred levels based on the data loaded therein. In addition, the storage capacitors in a second group of display cells have electrodes electrically connected to a second control line (e.g., S2) so that while duplicate display data is being loaded into the second group of cells, the second control line can be set to a predetermined potential. Based on capacitive coupling between the second control line and the pixel electrodes of the display cells in the second group, the voltages appearing across the liquid crystal capacitors in the second group of cells can also be set to preferred levels which are different from the preferred levels established in the first group of cells. These differences in voltage levels appearing across the liquid crystal capacitors in each respective plurality of cells result in the establishment of different transmittivities for the respective groups of cells (e.g., sub-pixels). These different transmittivities can then be utilized to improve the display's maximum viewing angle.

According to another embodiment of the present invention, a method of operating a display device is provided which comprises the steps of loading data from a plurality of data lines into a first plurality of display cells having gates commonly connected to a first gate line, during a first select time interval. First data from the data lines are then loaded into a second plurality of display cells having gates commonly connected to a second gate line, during a second select time interval, nonoverlapping with the first select time interval. Duplicate first data is then loaded into a third plurality of display cells having gates commonly connected to a third gate line, during a third select time interval, nonoverlapping with the second select time interval. The potential appearing across a liquid crystal capacitor in a display cell in the second plurality of cells is then switched to a first level based on the potential of the first gate line and the potential appearing across a corresponding liquid crystal capacitor in a display cell in the third plurality of cells is switched to a second level (which is unequal to the first level) based on the potential of the second gate line. Accordingly, for the case of a pixel image comprising two sub-pixels, the establishment of different potentials across the liquid crystal capacitors of corresponding display cells causes the sub-pixels to have different transmittivities (for the same loaded data) which improves the display device's maximum viewing angle.

DESCRIPTION OF PREFERRED EMBODIMENTS

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 6:
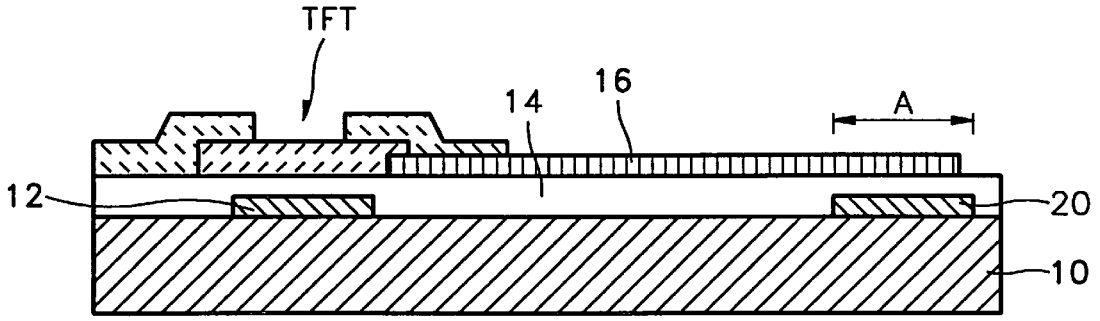
FIG. 6 is a sectional view showing a liquid crystal cell having a storage capacitor.

FIG. 6 is a cross sectional view of a liquid crystal cell having a storage capacitor. In FIG. 6, reference numeral 10 indicates a lower substrate of glass, reference numeral 12 indicates a gate electrode, reference numeral 14 indicates a gate insulating film, reference numeral 16 indicates a pixel electrode and reference numeral 20 indicates a storage electrode and reference character TFT indicates a thin-film switching transistor. The storage electrode 20 is typically formed at the same time the gate electrode 12 is formed. The storage capacitor is formed of a pixel electrode 16 and a storage electrode 20. The capacitance of the storage capacitor is determined by the area of a portion A where the pixel electrode 16 overlaps with the storage electrode 20.

In order to improve the characteristics of the display's viewing angle, the storage capacitance of two neighboring cells may be different. That is, the area of the portion A where the pixel electrode 16 overlaps with the storage electrode 20 may be varied for each cell. This can be implemented without additional fabrication processes and typically increases the display's maximum viewing angle.

Figure 7:
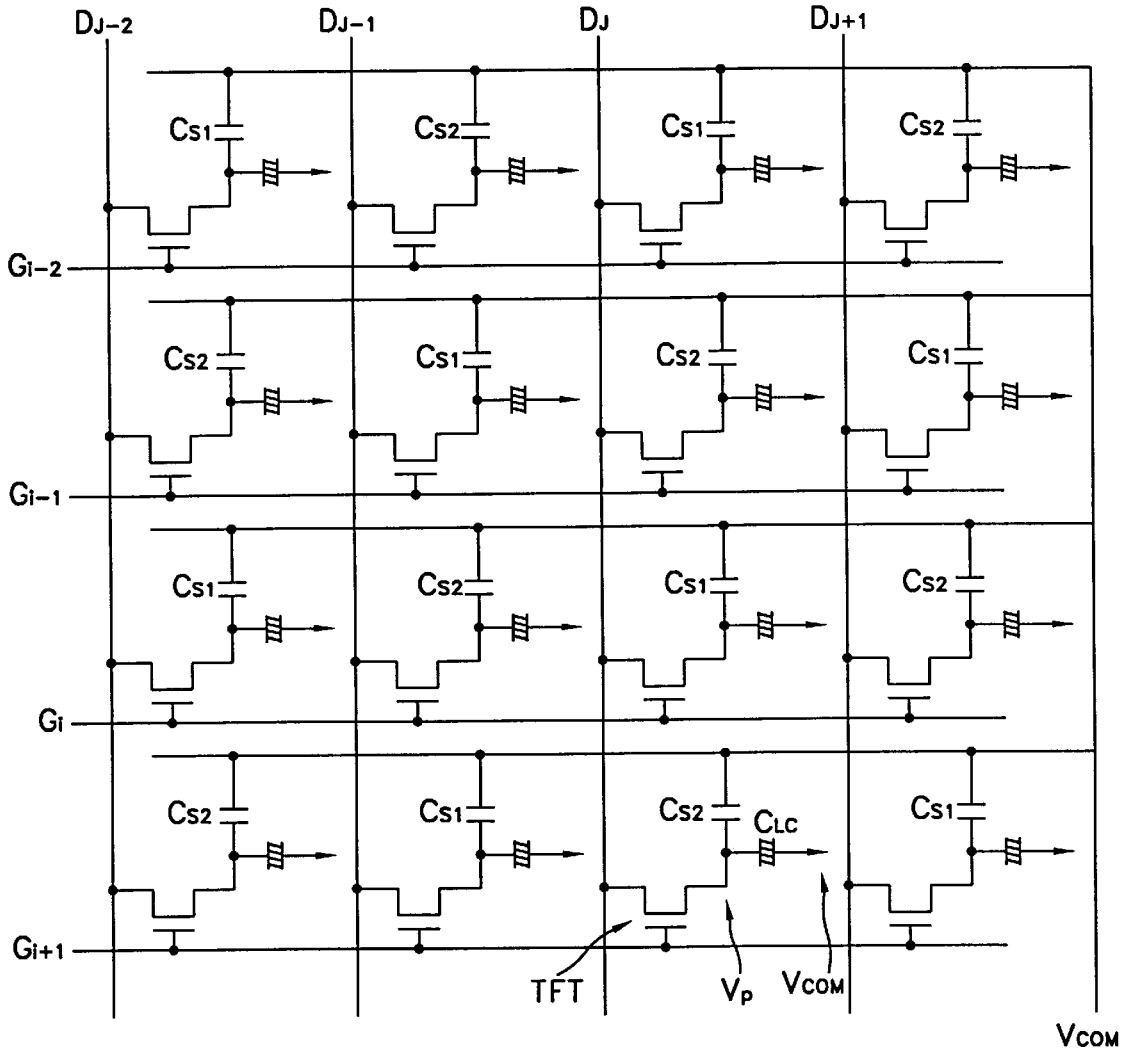
FIGS. 7–12 are schematic circuit diagrams showing various embodiments of liquid crystal display devices in which cells have different storage capacitors.

Referring to FIG. 7, a plurality of liquid crystal cells having storage capacitors $C_s$ and liquid crystal capacitors $C_{LC}$ are arranged as an array, and the electrostatic capacitance of the storage capacitor $C_s$ of each cell, i.e., a storage capacitance, takes one of two values ($C_{s1}$ or $C_{s2}$). A gate electrode of each thin film transistor (TFT) is connected to the corresponding gate line $G_{i-2}$, $G_{i-1}$, $G_i$ and $G_{i+1}$. A drain electrode of each TFT is connected to the corresponding data line $D_{i-2}$, $D_{i-1}$, $D_i$ and $D_{i+1}$, and a source electrode of each TFT is connected to the pixel electrode which constitutes one side of the liquid crystal capacitor $C_{LC}$ as well as one side of the storage capacitor $C_{S1}$ or $C_{S2}$. An electrode of the other side of the liquid crystal capacitor $C_{LC}$ and an electrode of the other side of the storage capacitors $C_{S1}$ and $C_{S2}$ are electrically coupled in common, to which a common voltage Vcom is applied via a reference signal line, as illustrated. In FIG. 7, two neighboring cells have different storage capacitors from each other, in both vertical and horizontal directions. Each liquid crystal cell is coupled to a gate line and a data line.

Figure 8:
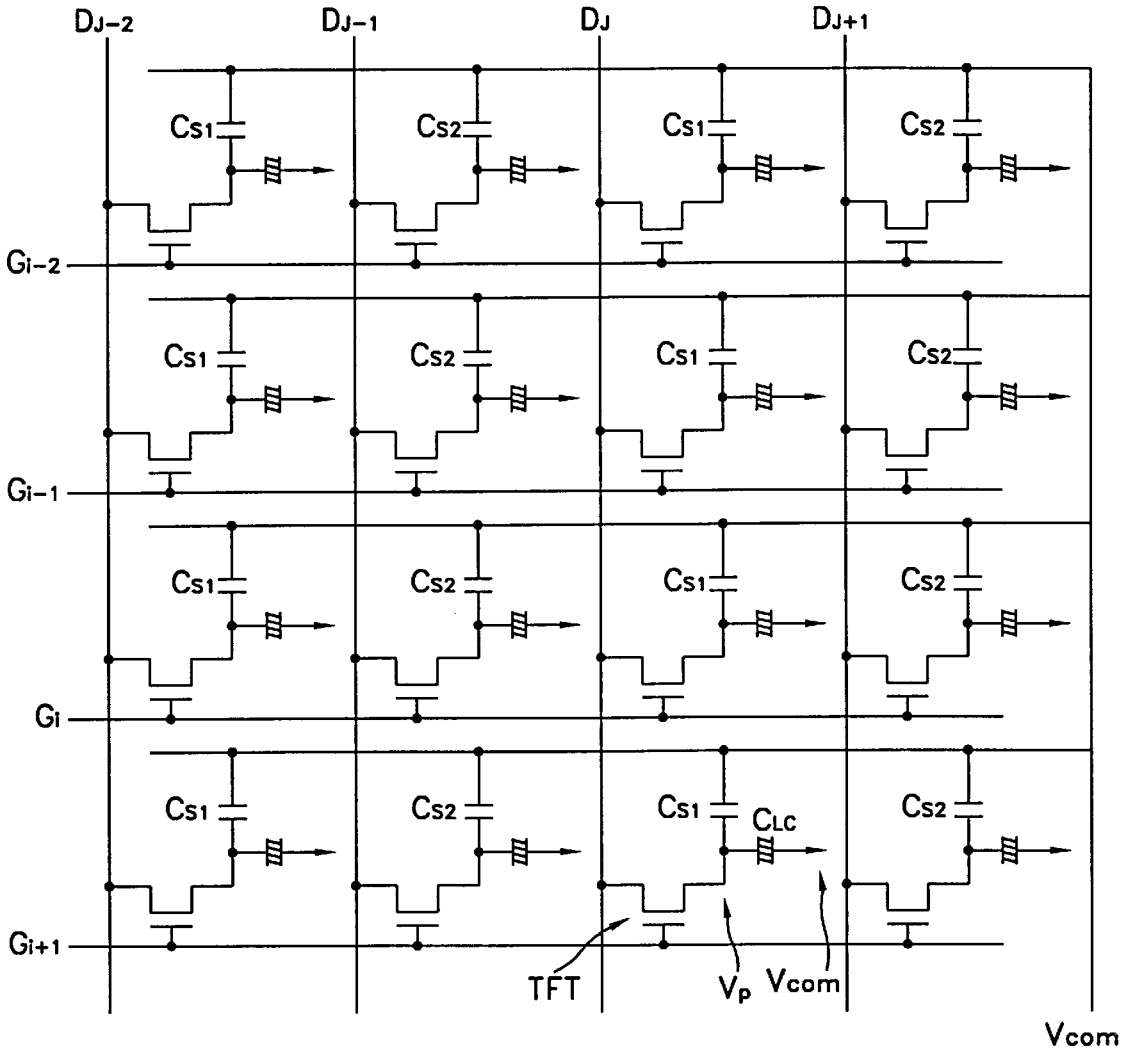
Figure 9:
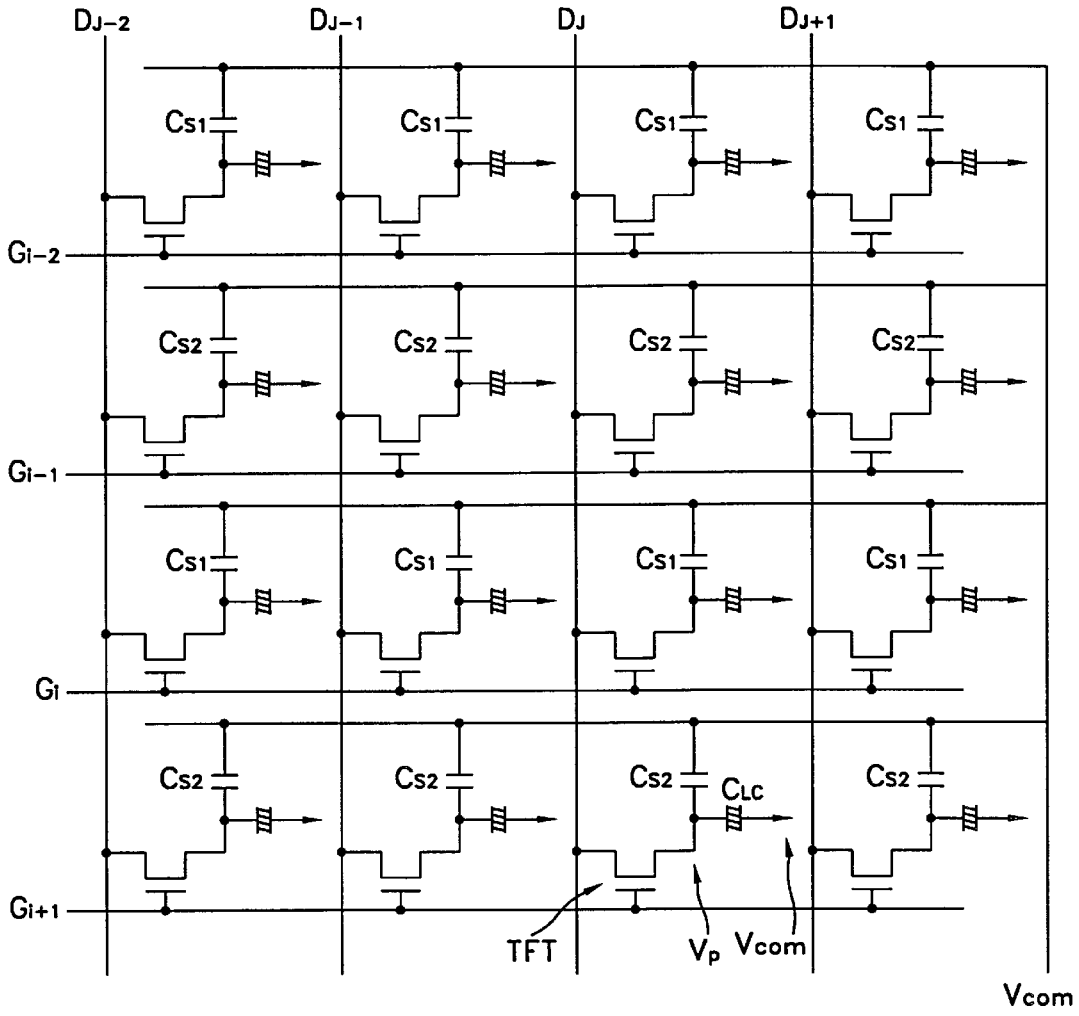

Referring to FIGS. 8 and 9, two neighboring liquid crystal cells have different storage capacitances in only one direction, that is, in a horizontal direction along a row of cells (see FIG. 8) or in a vertical direction (see FIG. 9). In FIGS. 8 and 9, as in FIG. 6, each liquid crystal cell is connected to a gate line and a data line. In FIG. 8, liquid crystal cells having different storage capacitances are driven by different data lines. In contrast, in FIG. 9, liquid crystal cells having different storage capacitances are driven by different gate lines.

Figure 10:
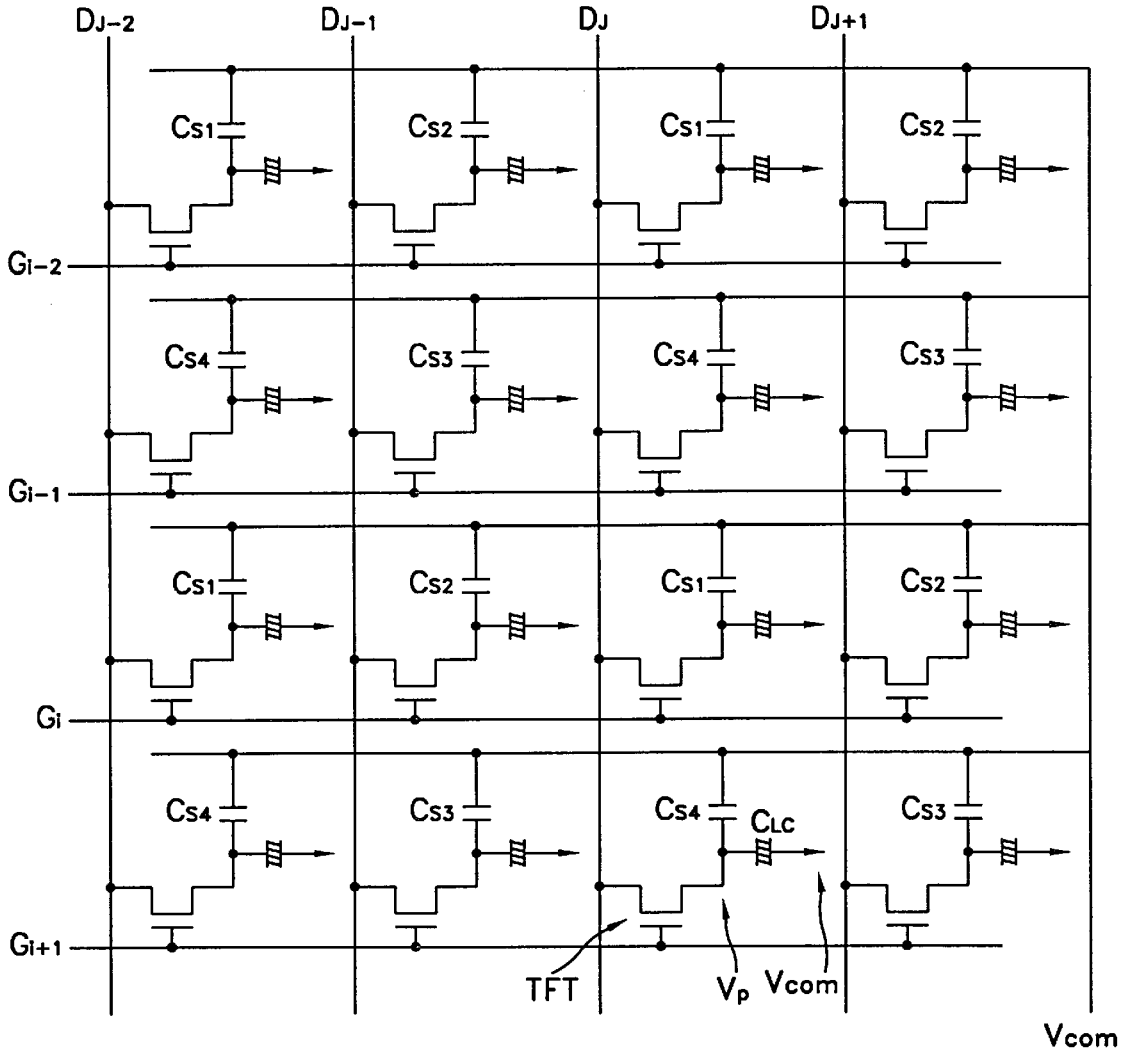
Figure 11:
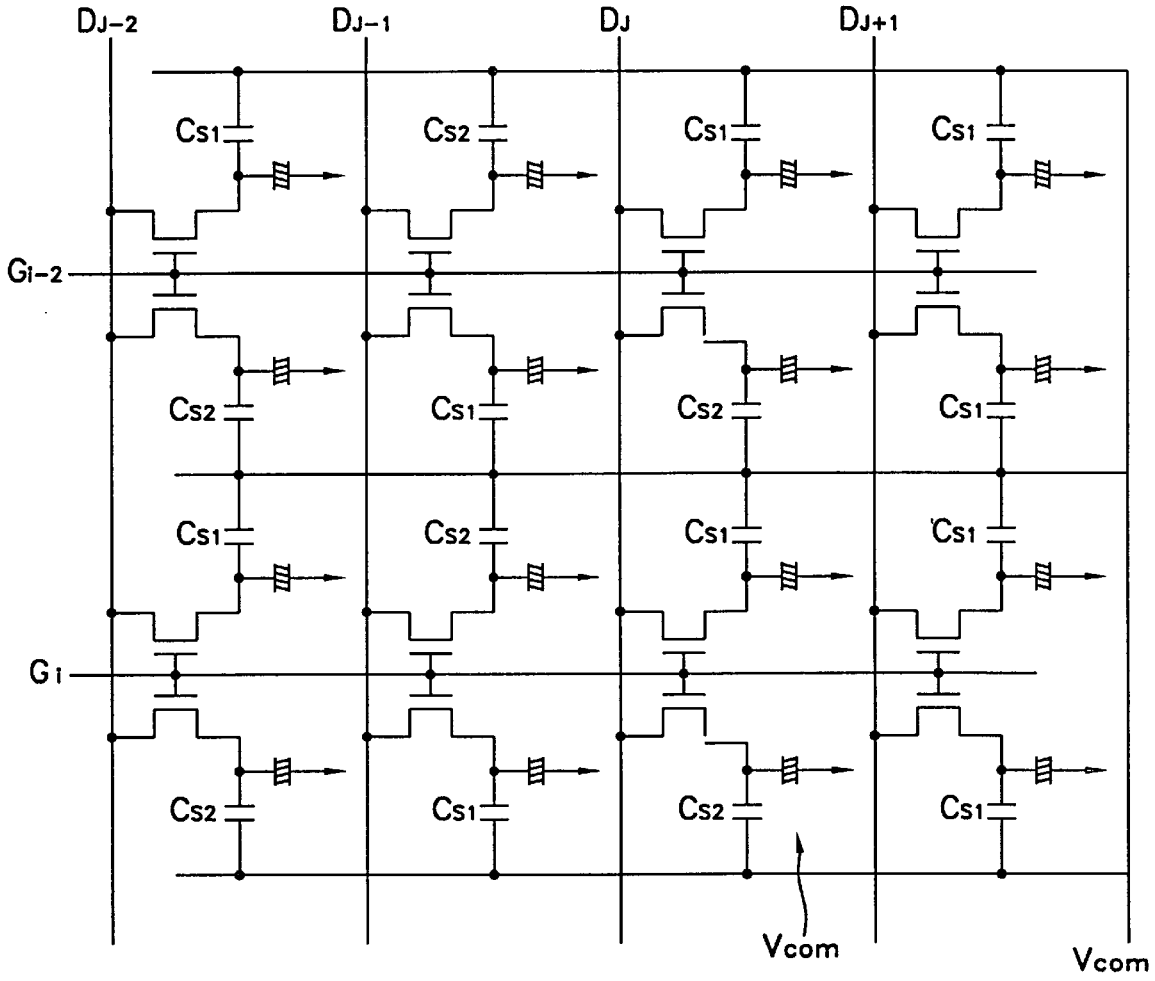

Referring to FIG. 10, the storage capacitance of each liquid crystal cell takes one of four values, and the storage capacitances of the four neighboring liquid crystal cells are different from one another. In FIG. 10, as in FIG. 6, each liquid crystal cell is connected to a gate line and a data line. In FIG. 11, as in FIG. 6, each of the liquid crystal cells takes one of two storage capacitances, and liquid crystal cells having different storage capacitances are alternately arranged in both vertical and horizontal directions. However, unlike FIG. 6, two neighboring liquid crystal cells in the vertical direction (and having different storage capacitances) have their gates commonly coupled to a gate line and their drains commonly coupled to a data line. Thus, two liquid crystal cells having different storage capacitances (and arranged in the vertical direction) are driven by the same gate and data lines. Here, the two liquid crystal cells having different storage capacitances form one pixel image containing two sub-pixels. The difference in storage capacitances causes a difference in effect voltage applied to the liquid crystal, to thereby cause differences in transmittivities. Accordingly, the sensitivity to the viewing angle is reduced in this device, because the range of the viewing angle varies in accordance with variations in the transmittivities of the cells.

Figure 12:
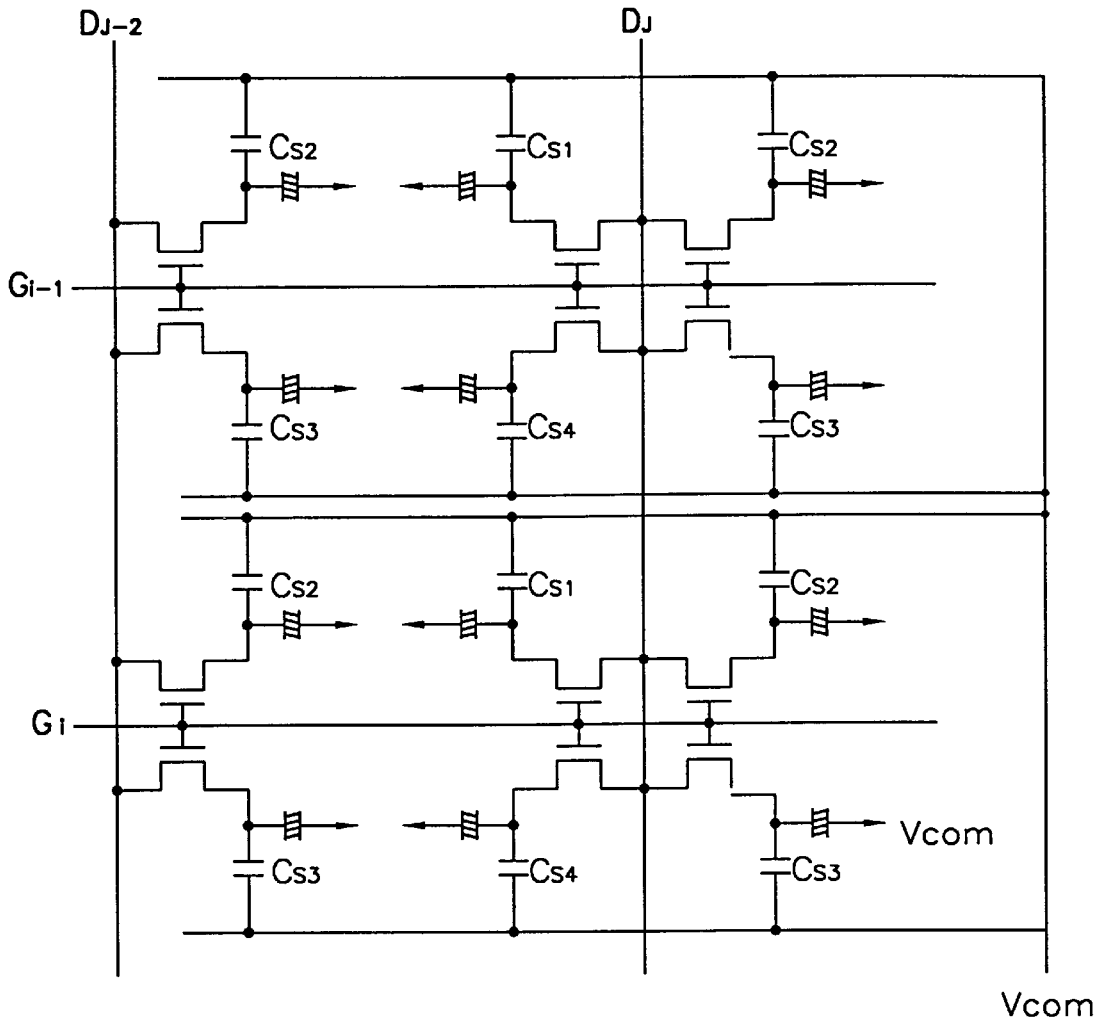

In FIG. 12, as in FIG. 10, the storage capacitance of each liquid crystal cell takes one of four values, and the storage capacitances of four neighboring liquid crystal cells in FIG. 10 are different from one another. However, unlike the display in FIG. 10, the four neighboring liquid crystal cells in FIG. 12 which have different storage capacitances are commonly coupled to a gate line and commonly coupled to a data line. Accordingly, an identical data voltage is applied to all four liquid crystal cells having different storage capacitances, so that the display's maximum viewing angle can be increased. Here, the four cells form one pixel image containing four sub-pixels.

Referring again to FIGS. 7–12, each of the gate lines is sequentially driven and the data voltages for driving each of the liquid crystal cells are applied to each of the data lines. For example, supposing that an identical data voltage is applied to all liquid crystal cells, a storage capacitor $C_{S1}$ and a liquid crystal capacitor $C_{LC}$ of an arbitrary liquid crystal cell are charged in accordance with their capacitances, respectively. Also, a storage capacitor $C_{S2}$ and a liquid crystal capacitor $C_{LC}$ of a neighboring liquid crystal cell are also charged in accordance with their capacitances, respectively. Accordingly, the charge ("Q") accumulated by the storage capacitors of the two adjacent liquid crystal cells are different, and further a discharge rate of the storage capacitors and a voltage drop rate of the pixel electrodes becomes different when their TFTs are turned off. As a result, the effective voltages applied to the liquid crystal of the two adjacent liquid crystal cells connected to the same gate line are different, and further the effective voltages applied to the liquid crystal of the cells are different, so that the transmittivities of light therethrough are different. Accordingly, the sensitivity to the viewing angle is reduced in this device. In other words, the characteristics of the viewing angle are increased which means the liquid crystal display can be viewed from a greater angle relative to normal to the surface.

Figure 13:
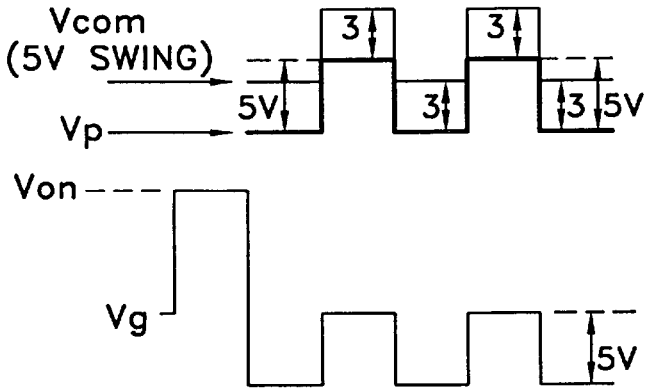
FIG. 13 (PRIOR ART)
FIG. 13 is a waveform diagram illustrating a method of driving the liquid crystal display devices shown in FIGS. 7–12.

Referring now to FIG. 13, a thin solid line of an upper portion represents a common voltage Vcom, and a thick solid line of a middle portion represents a pixel electrode voltage Vp, and a thin solid line of a lower portion represents a gate voltage Vg. For a driving signal of the gate line Gi, as shown in FIG. 13, a turn-on voltage Von is applied to the gate line during a selection period, while an alternating or AC voltage (swung by 5V) is applied to the gate line during a non-selection period. In addition, an AC voltage (swung by 5V) of the common voltage Vcom is applied to the common electrode. When a gate is applied with the turn-on voltage Von, the corresponding TFTs are turned on. Thus, without the voltage drop across the channel of the TFT being taken into consideration, the voltage corresponding to the difference between the common voltage Vcom and the data line voltage is applied to the liquid crystal capacitor $C_{LC}$ and the related storage capacitor to thereby accumulate charges thereon in accordance with their capacitances. When the TFT is turned off, the voltage by the accumulated charges is applied to the liquid crystal capacitor $C_{LC}$ and the storage capacitor. At this time, due to capacitance coupling, a variation of the common voltage Vcom causes a variation in the voltage Vp which denotes the voltage of the pixel electrode constituting one side of both the liquid crystal capacitor and the storage capacitor (i.e., the source side of the TFT).

However, in FIGS. 7–12, since the transmittivities of neighboring liquid crystal cells are changed according to capacitances of the storage capacitors $C_{S1}$ and $C_{S2}$, the difference in transmittivities may be too small to cause a noticeable improvement in the display's maximum viewing angle. Also, if the driving method shown in FIG. 13 is applied to the TFT LCDs shown in FIGS. 7–12, it is not easy to compensate for any deviations caused by variations in fabrication parameters. Accordingly, a more effective driving methodology for increasing a display's maximum viewing angle is required.

Before providing a description of preferred methods for driving liquid crystal display devices according to the present invention, some basic fundamentals relating to the application of driving voltages to a liquid crystal display cell, containing a thin-film switching transistor (TFT), a storage capacitor and a liquid crystal capacitor therein, will be described. When a gate of a cell's TFT is applied with a turn-on voltage Von, the corresponding TFT is turned on. Thus, without the voltage drop by the TFT being taken into consideration, a voltage equal to a difference between the common voltage Vcom and the voltage (Vdata) applied to a cell's data line (i.e., drain of the TFT) is applied across the liquid crystal capacitor $C_{LC}$ and the related storage capacitor $C_S$ to thereby accumulate charges thereon in accordance with their capacitances.

Figure 18:
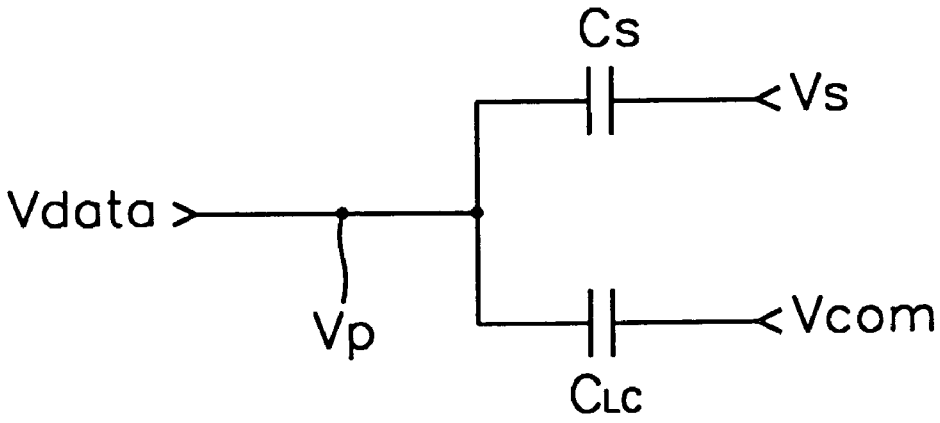
FIG. 18 is an equivalent electrical schematic diagram of a liquid crystal display cell when a TFT therein has been turned on to electrically connect a pixel electrode ($V_p$) to a data line ($V_{data}$).

In detail, FIG. 18 shows an equivalent circuit of a liquid crystal cell when the TFT is turned-on. When the TFT is turned-on, a data voltage (Vdata) is applied to one end of the liquid crystal capacitor $C_{LC}$ and the common voltage (Vcom) is applied to the other end thereof. That is, a pixel electrode voltage (Vp) becomes equal to the data voltage, to thereby apply a voltage (Vdata−Vcom) to the liquid crystal capacitor $C_{LC}$. At this time, a quantity of charge "$Q_2$" equal to $C_S\times(\text{Vdata}-V_S)$ is accumulated on the storage capacitor $C_S$, and a quantity of charge "$Q_1$" equal to $C_{LC}\times(\text{Vdata}-\text{Vcom})$ is accumulated on the liquid crystal capacitor.

Accordingly, the amount of charge accumulated on the pixel electrode can be expressed as follows:

$$Q = Q_1 + Q_2$$
$$= C_{LC}(Vdata - Vcom) + C_s(Vdata - Vs)$$

where reference character Q denotes the total amount of charge accumulated on the pixel electrode, Q1and Q2 denote the total amounts of charges accumulated by the liquid crystal capacitor and by the storage capacitor, respectively, and reference character Vdata denotes a voltage applied by the data line, Vs denotes a voltage applied to the other end of the storage capacitor and Vcom denotes a voltage applied to the common electrode. As shown in the above formula, the charge Q accumulated on the pixel electrode can be adjusted by adjusting the voltage (Vs) applied to the other end of the storage capacitor.

Figure 19:
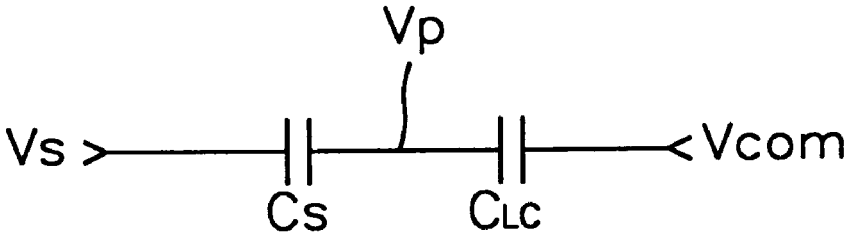
FIG. 19 is an equivalent electrical schematic diagram of a liquid crystal display cell when a TFT therein has been turned off.

FIG. 19 shows an equivalent circuit of a liquid crystal cell when the TFT is turned-off. Referring to FIG. 19, when the TFT is turned-off, the pixel electrode and the data line are electrically disconnected. A voltage Vs is applied to the other end of the storage capacitor, a common voltage Vcom is applied to the other end of the liquid crystal capacitor and charges Q are stored on the pixel electrode.

Accordingly, when the TFT is turned-off (that is, during a non-selection period), the pixel electrode voltage Vp can be expressed as follows:

$$Vp = \frac{Q}{C_{LC} + C_s} + \frac{C_{LC}}{C_{LC} + C_s} Vcom + \frac{C_s}{C_{LC} + C_s} Vs$$

When the TFT is turned-off, the voltage ($V_{LC}$) appearing across the liquid crystal capacitor can be expressed as follows:

$$V_{LC} = Vp - Vcom$$
$$= \frac{Q}{C_{LC} + C_s} + \left(\frac{C_{LC}}{C_{LC} + C_s} - 1\right) Vcom + \frac{C_s}{C_{LC} + C_s} Vs$$

As shown in the above equation, the voltage applied to the liquid crystal capacitor during a turned-off or non-selection period is different according to the different amounts of charges accumulated during a turned-on period of time (i.e., selection period) and according to a control voltage Vs applied to the other end of the storage capacitor $C_S$ during a turned-off period.

Figure 14A:
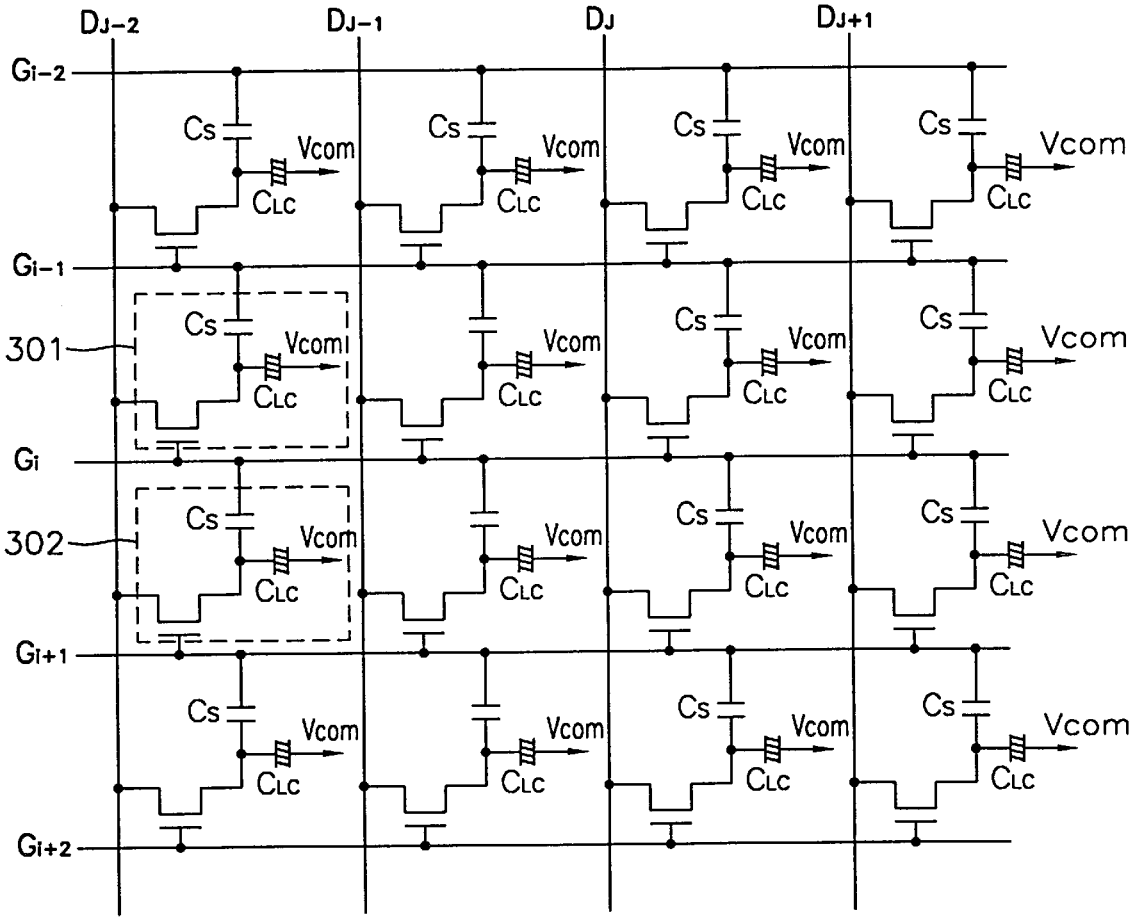
FIGS. 14A–14B illustrate preferred liquid crystal display devices according to first and second embodiments of the present invention, respectively.

FIGS. 14A through 14F are circuit diagrams for explaining a driving method of a TFT liquid crystal display device according to an embodiment of the present invention. Referring to FIG. 14A, a plurality of liquid crystal cells each having a storage capacitor $C_s$, and a liquid crystal capacitor $C_{LC}$ are arranged as a two-dimensional array of cells. Here, the capacitances of the storage capacitors are substantially equal and the capacitances of the liquid crystal capacitors are substantially equal.

In a thin film transistor (TFT) provided in each liquid crystal cell, a gate thereof is coupled to a corresponding gate line arranged in a row direction, a drain thereof is coupled to a corresponding data line arranged in a column direction, and a source thereof is coupled to a corresponding pixel electrode constituting one side of the liquid crystal capacitor $C_{LC}$ and one side of the storage capacitor $C_S$. The other sides of the liquid crystal capacitors $C_{LC}$ in the cells are commonly connected to a common electrode to which a common voltage Vcom is applied. On the other hand, the other side of the storage capacitor is coupled to the neighboring gate line, especially to the upper gate line as illustrated best by FIG. 14A.

Figure 14B:
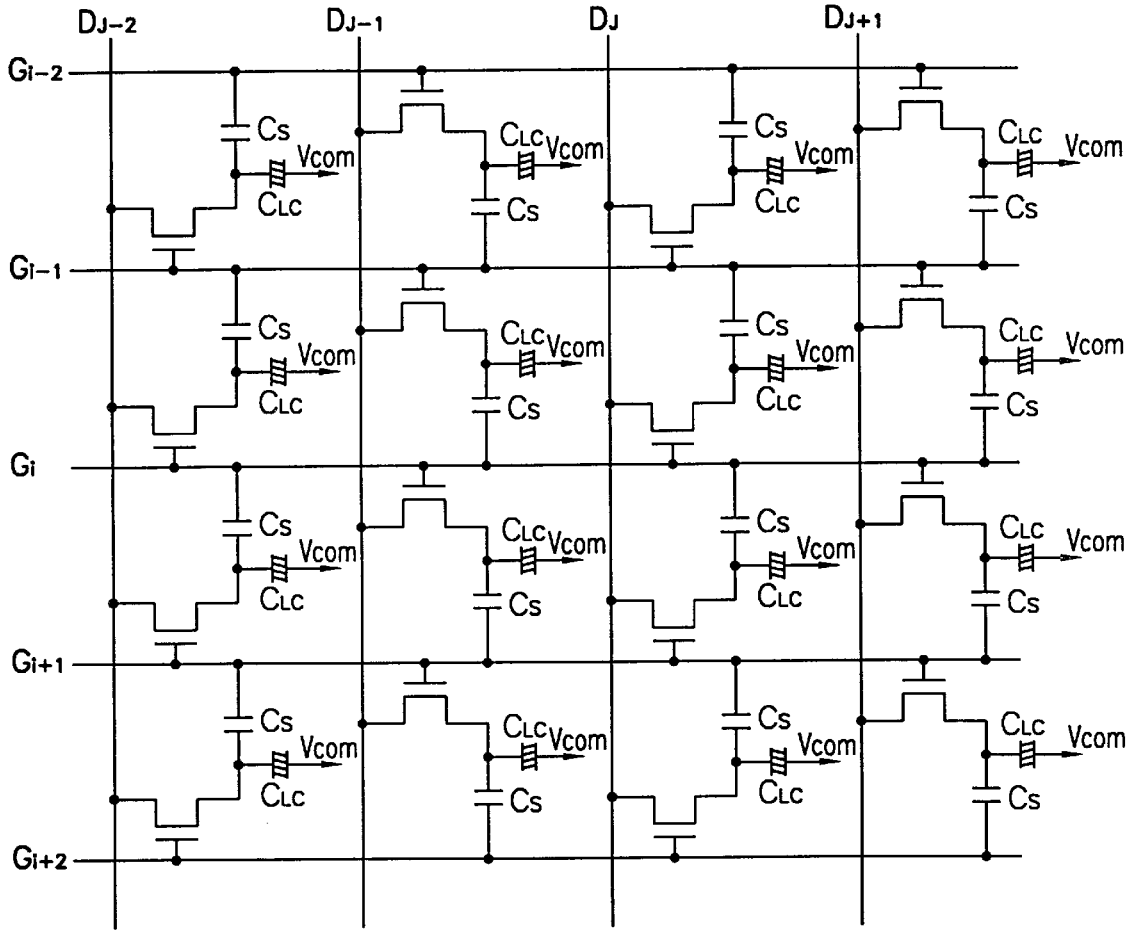

FIG. 14B is a schematic diagram of a TFT liquid crystal display panel which can adopt one embodiment of the driving method according to the present invention. Referring to FIG. 14B, one liquid crystal cell is composed of one TFT, a storage capacitor $C_S$ and a liquid crystal capacitor $C_{LC}$. The TFTS of two neighboring cells in a row direction are coupled to different gate lines and the storage capacitors thereof are coupled to different gate lines as illustrated.

Figure 14C:
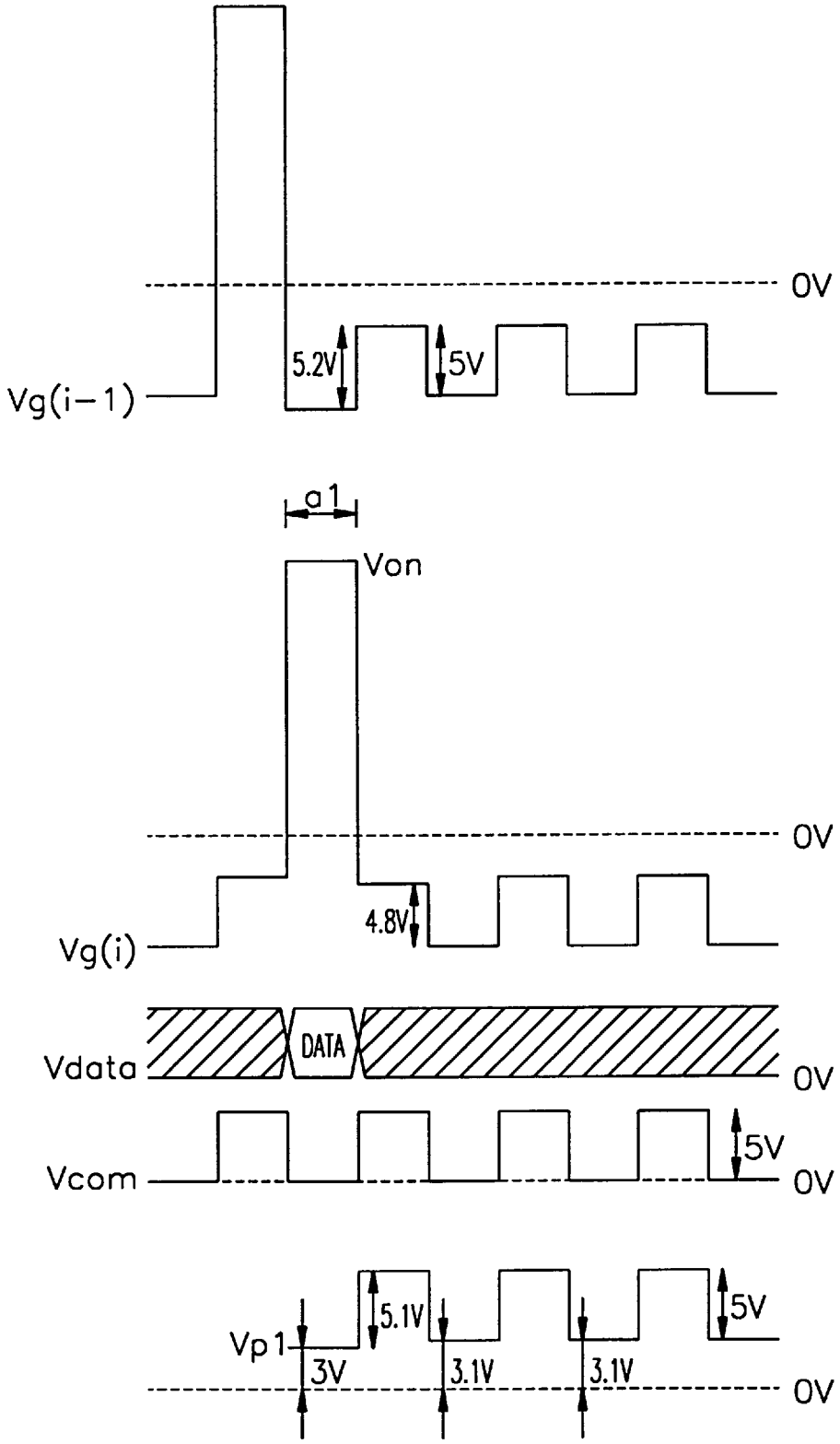
FIGS. 14C–14F are timing diagrams illustrating a method of driving the display devices of FIGS. 14A and 14B according to the present invention.
Figure 14D:
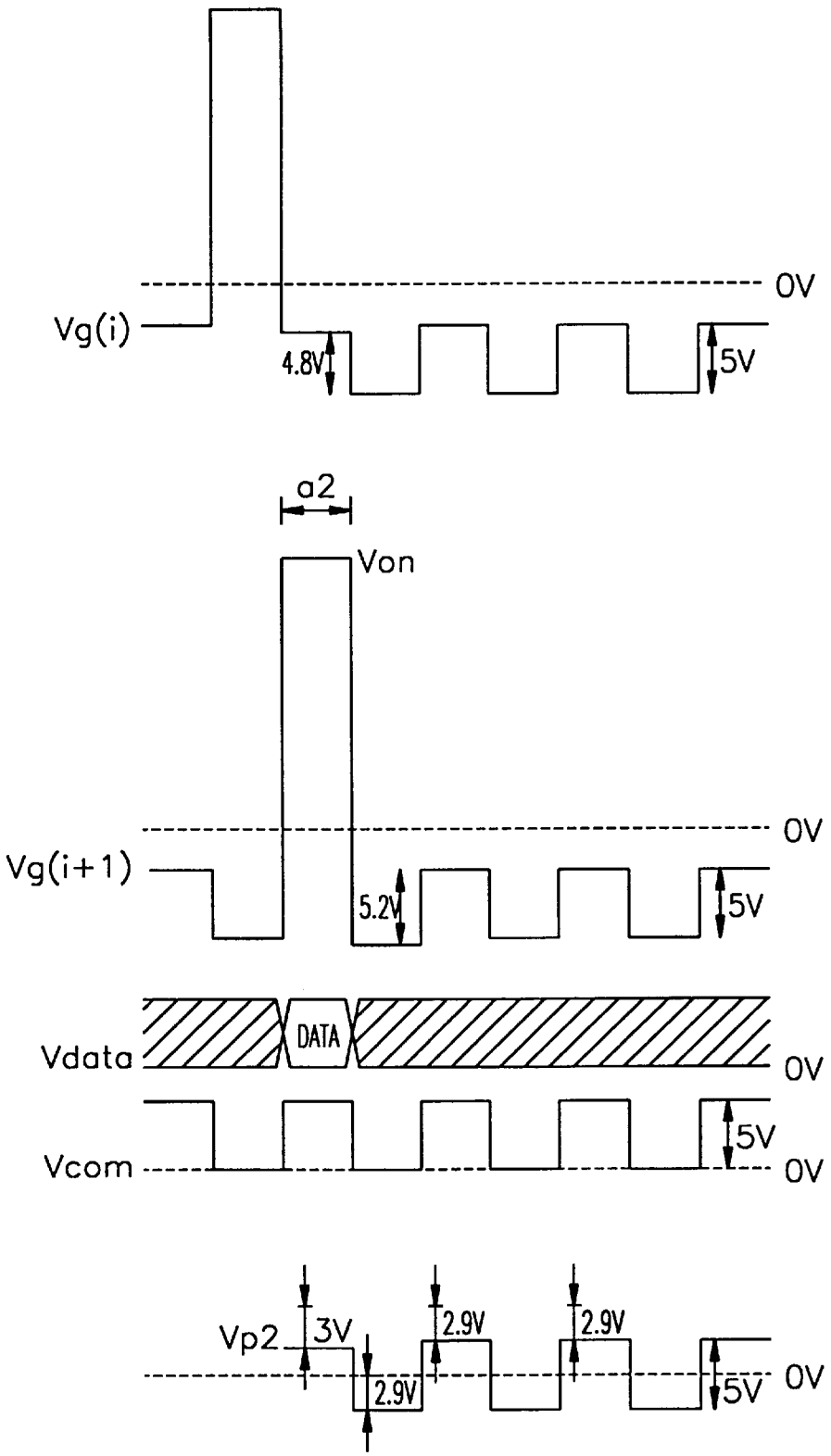

FIGS. 14C–14F show the waveforms of various driving signals according to one embodiment of the present invention. In particular, FIG. 14C shows waveforms of signals applied to a liquid crystal cell 301 of FIG. 14A, and FIG. 14D shows waveforms of signals applied to a liquid crystal cell 302 of FIG. 14A. Referring to FIG. 14C, an upper gate voltage Vg(i–1) is applied to the other end of a storage capacitor of the liquid crystal cell 301, and a gate voltage Vg(i) is applied to a gate of the TFT of the liquid crystal cell 301. The upper gate voltage Vg(i–1), which is the control voltage Vs of the liquid crystal cell 301, is a turn-on voltage Von during the selection period of the gate line Gi–1 and is deeply swung such as swung by 5.2V during the first horizontal interval "a1" of the non-selection period of the gate line Gi–1. Then, during the remaining portion of the non-selection period with respect to gate line Gi–1, the gate voltage Vg(i–1) is normally swung such as by 5V.

The gate voltage Vg(i) of the liquid crystal cell 301 is then sequentially set to a turn-on voltage Von during the selection period "a1" of the gate line Gi, and is shallowly swung (such as swung by 4.8V) during the first horizontal interval of the non-selection period of the gate line Gi.

Then, during the remaining portion of the non-selection period with respect to gate line Gi, the gate voltage Vg(i) is normally swung such as swung by 5V. Here, to achieve non-interlace scanning, the first horizontal interval of the non-selection period of the gate line Gi–1 occurs at the same time as the selection period of the gate line Gi. In the gate voltages, a turn-on voltage is generally 20V or more, and the voltage levels of normal swing voltages during the turn-off period are −3V and −8V, respectively.

The common voltage Vcom is a 5V swing voltage whose voltage levels are alternately changed between 0V and 5V in every horizontal interval. A data voltage for the gate line Gi is applied during the "a1" period. The data voltage Vdata usually has a value of 0V through 5V and the absolute value of the difference between the data voltage Vdata and the common voltage Vcom is proportioned to the data to be displayed. That is, in the case that the common voltage Vcom is 0V, the data voltage Vdata is increased according to the data to be displayed, and in the case that the common voltage Vcom is 5V, the data voltage Vdata is reduced according to the data to be displayed.

In the case that a data voltage Vdata applied to the liquid crystal cell 301 during selection period "a1 " 3V and the common voltage Vcom is 0V, a pixel electrode voltage Vp1 of the liquid crystal cell 301 will be described as follows. During selection period "a1", the pixel electrode voltage Vpl equals the data voltage Vdata, so that a voltage of Vp1–Vcom=3–0=3V is applied across the liquid crystal capacitor $C_{LC}$. Assuming that $C_S$ is 0.5 pF and $C_{LC}$ is 0.5 pF, charges Q accumulated on the pixel electrode of the liquid crystal cell 301 during the turn-on selection period is expressed as follows:

$$\begin{aligned} Q &= C_{LC}(Vdata - Vcom) + C_s(Vdata - V_s) \\ &= 0.5\,\text{pF}(3\,\text{V}) + 0.5\,\text{pF}(3\,\text{V} - (-3\,\text{V} - 5.2\,\text{V})) \\ &= 0.5\,\text{pF}(14.2\,\text{V}) \end{aligned}$$

In addition, the pixel voltage Vp1 during the first horizontal interval of the non-selection period can be expressed as follows:

$$\begin{aligned} Vp1 &= (Q/(C_{LC} + C_s)) + (C_{LC}/(C_{LC} + C_s))Vcom + (C_s/(C_{LC} + C_s))Vs \\ &= 0.5\,\text{pF}(14.2\,\text{V})/1.0\,\text{pF} + (0.5\,\text{pF}/1.0\,\text{pF})5\,\text{V} + (0.5\,\text{pF}/1.0\,\text{pF})(-3\,\text{V}) \\ &= 8.1\,\text{V} \end{aligned}$$

Accordingly, the voltage applied across the liquid crystal capacitor $C_{LC}$ of the liquid crystal cell 301 during the first horizontal interval of the non-selection period is as follows:

$$\begin{aligned} V_{LC} &= Vp1 - Vcom \\ &= 8.1\,\text{V} - 5\,\text{V} \\ &= 3.1\,\text{V} \end{aligned}$$

The voltage applied to the liquid crystal capacitor as shown in the above formula is maintained during the non-selection period.

Figure 14E:
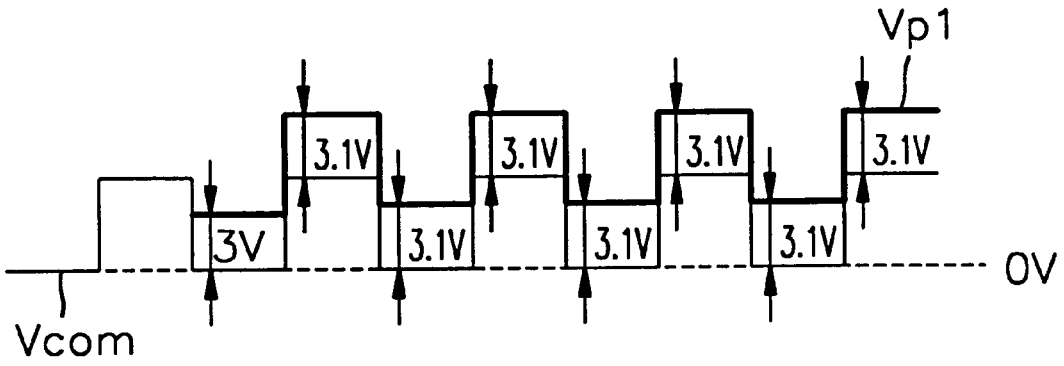

In FIG. 14E, a signal waveform of a pixel electrode voltage Vp1 and a signal waveform of a common voltage Vcom are commonly depicted in order to graphically represent the voltage $V_{LC}$ appearing across the liquid crystal capacitor. Here, Vp1 represents the voltage of the pixel electrode coupled through its related storage capacitor to the gate line Gi–1. The deep swing of the gate voltage can be performed during one or more horizontal intervals of the non-selection period instead of the first horizontal interval of the non-selection period, as illustrated. For example, any one of the second, third, . . . horizontal intervals of the non-selection period can be selected for the deep swing of the gate voltage.

FIG. 14D shows waveforms of various signals applied to the liquid crystal cell 302 adjacent to the liquid crystal cell 301 of FIG. 14A. Referring to FIG. 14D, an upper gate voltage Vg(i) (as a control voltage Vs) is applied to the other end of the storage capacitor of the liquid crystal cell 302, and a gate voltage Vg(i+1) is applied to a gate of the TFT of the liquid crystal cell 302. The upper gate voltage Vg(i) is a turn-on voltage Von during the selection period of the gate line Gi and is shallowly swung (such as swung by 4.8V) during the first horizontal interval "a2" of the non-selection period of the gate line Gi. Then, during the remaining portion of the non-selection period, the gate voltage Vg(i) is normally swung such as swung by 5V.

The gate voltage Vg(i+1) of the liquid crystal cell 302 is a turn-on voltage Von during the selection period "a2" of the gate line Gi+1 and is deeply swung such as swung by 5.2 during the first horizontal interval "a2" of the non-selection period of the gate line Gi. Then, during the remaining portion of the nonselection period, the gate voltage Vg(i+1) is normally swung such as by 5V. A usual value of the gate voltage and that of the common voltage are the same as those of FIG. 14C. The data voltage for the gate line Gi+1 is also applied during the selection period "a2".

In the case that during the selection period "a2" the data voltage Vdata applied to the liquid crystal cell 302 is 2V and the common voltage Vcom applied thereto is 5V, the pixel electrode voltage Vp2 of the liquid crystal cell 302 is expressed as follows. During the selection period, the pixel electrode voltage Vp2 is equal to the data voltage Vdata, so that a voltage of (Vcom−Vp2=5−2=3V) is applied across the liquid crystal capacitor $C_{LC}$. Assuming that $C_S$ is 0.5 pF and $C_{LC}$ is 0.5 pF, charges Q accumulated in the pixel electrode of the liquid crystal cell 302 during the turn-on period is expressed as follows:

$$\begin{aligned} Q &= C_{LC}(Vdata - Vcom) + C_s(Vdata - Vs) \\ &= 0.5\,\text{pF}(-3\,\text{V}) + 0.5\,\text{pF}(2\,\text{V} - (-8\,\text{V} - 4.8\,\text{V})) \\ &= 0.5\,\text{pF}(2.2\,\text{V}) \end{aligned}$$

The pixel electrode voltage Vp2 during the first horizontal interval of the non-selection period can be expressed as follows:

$$\begin{aligned} Vp2 &= Q/(C_{LC} + C_s) + (C_{LC}/(C_{LC} + C_s))Vcom + (C_s/(C_{LC} + C_s))Vs \\ &= 0.5\,\text{pF}(2.2\,\text{V})/1.0\,\text{pF} + (0.5\,\text{pF}/1.0\,\text{pF})(0\,\text{V}) + (0.5\,\text{pF}/1.0\,\text{pF})(-8\,\text{V}) \\ &= -2.9\,\text{V} \end{aligned}$$

Accordingly, a voltage applied to the liquid crystal capacitor of the liquid crystal cell 302 during the first horizontal interval of the non-selection period can be expressed as follows:

$$\begin{aligned} V_{LC} &= Vp2 - Vcom \\ &= -2.9\,\text{V} - 0\,\text{V} \\ &= -2.9\,\text{V} \end{aligned}$$

Figure 14F:
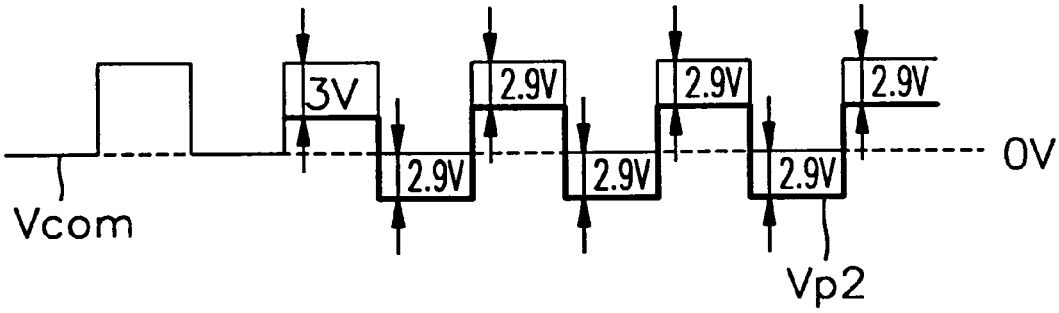

The voltage applied to the liquid crystal capacitor as expressed by the above formula is maintained during the nonselection period. In FIG. 14F, a waveform of a pixel electrode voltage Vp2 is depicted with a waveform of a common voltage Vcom in order to graphically represent the voltage $V_{LC}$ across the liquid crystal capacitor $C_{LC}$ in cell 302.

As shown in FIGS. 14E and 14F, in the two neighboring liquid crystal cells 301 and 302, even though the differences between the data voltage Vdata and the common voltage Vcom during the respective selection periods are equal to each other, the effective values of the liquid crystal voltage $V_{LC}$ during the non-selection periods become 3.1V and 2.9V, respectively, to thereby make a difference of 0.2V. In other words, the absolute value of $V_{LC}$ in cell 301 is maintained at 3.1V during the nonselection period and the absolute value of $V_{LC}$ in cell 302 is maintained at 2.9V during the non-selection period. Because of the difference in the control voltage Vs applied during the selection period, the effective voltages across the liquid crystal capacitors during the non-selection periods are different. Since the effective voltages applied across the liquid crystal capacitors in neighboring cells are different, the twisted degrees of liquid crystals are different, so that the transmittivities of light therethrough are different. As will be understood by those skilled in the art, the ability to achieve and maintain the voltages appearing across the liquid crystal capacitors of adjacent cells during the non-selection period is also significant because the twist degree and transmittivity of the liquid crystal cell is affected not by the polarity but by the absolute value of $V_{LC}$. As a result, in the liquid crystal display shown in FIGS. 14A and 14B, by being driven by the method shown in FIGS. 14C–14F, the characteristics of the viewing angle is improved because the maximum viewing angle is increased.

Figure 15A:
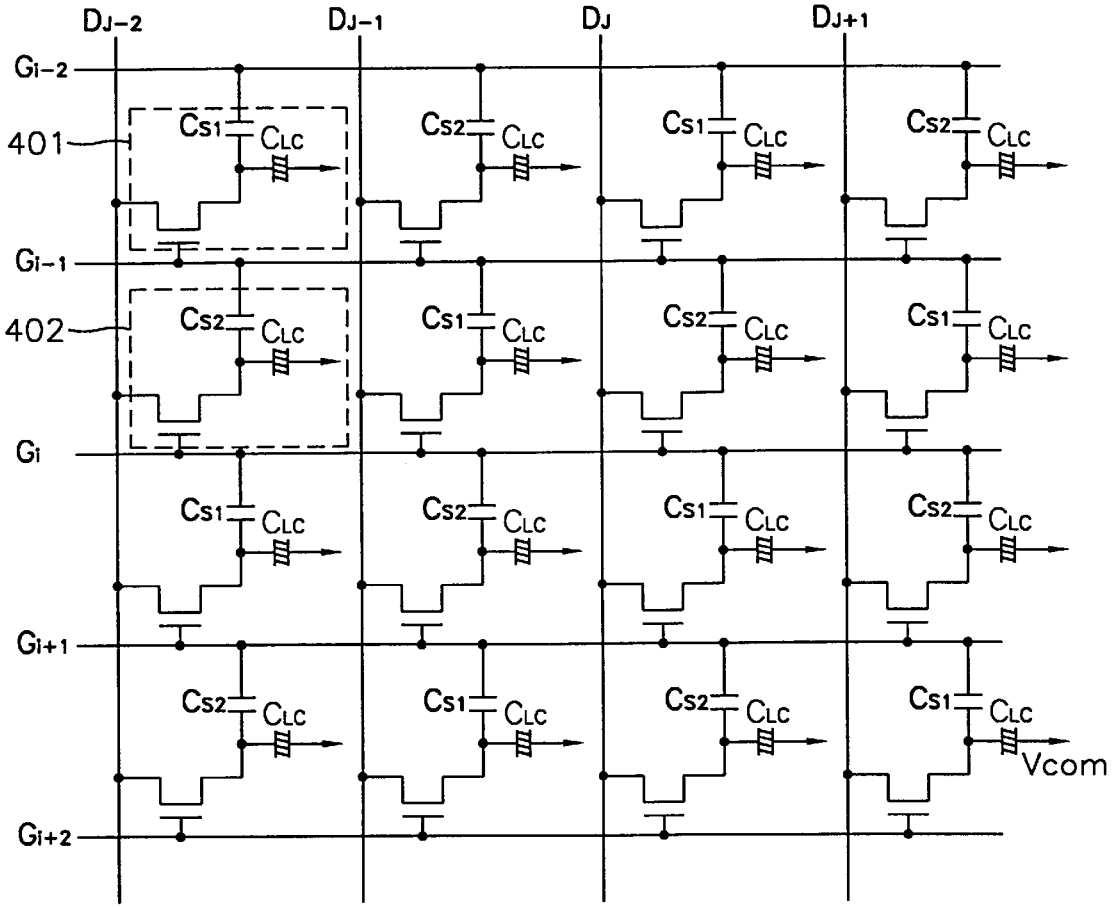
FIG. 15A illustrates a preferred liquid crystal display device according to a third embodiment of the present invention.
Figure 15B:
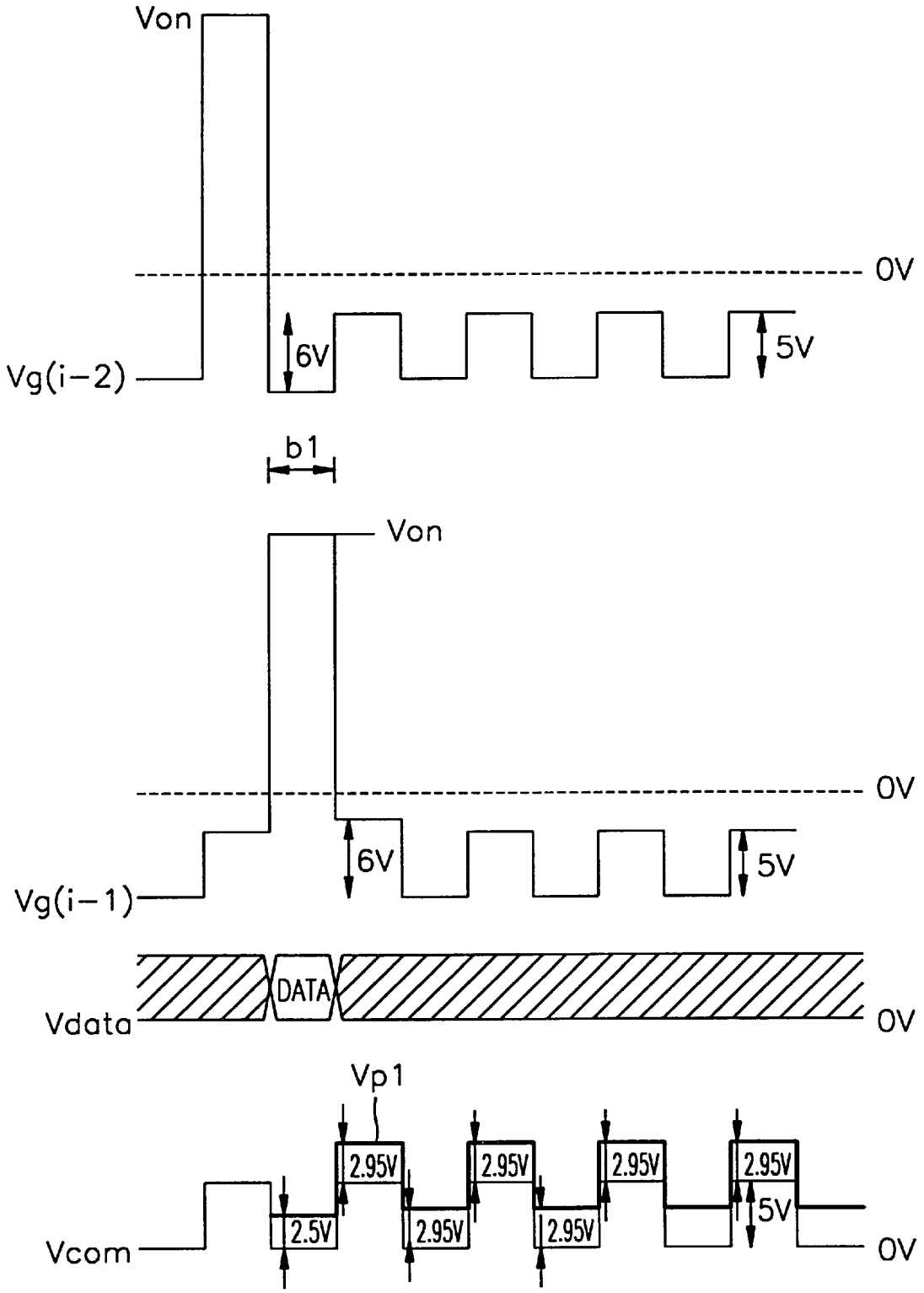
FIGS. 15B–15C are timing diagrams illustrating a method of driving the display device of FIGS. 15A according to the present invention.
Figure 15C:
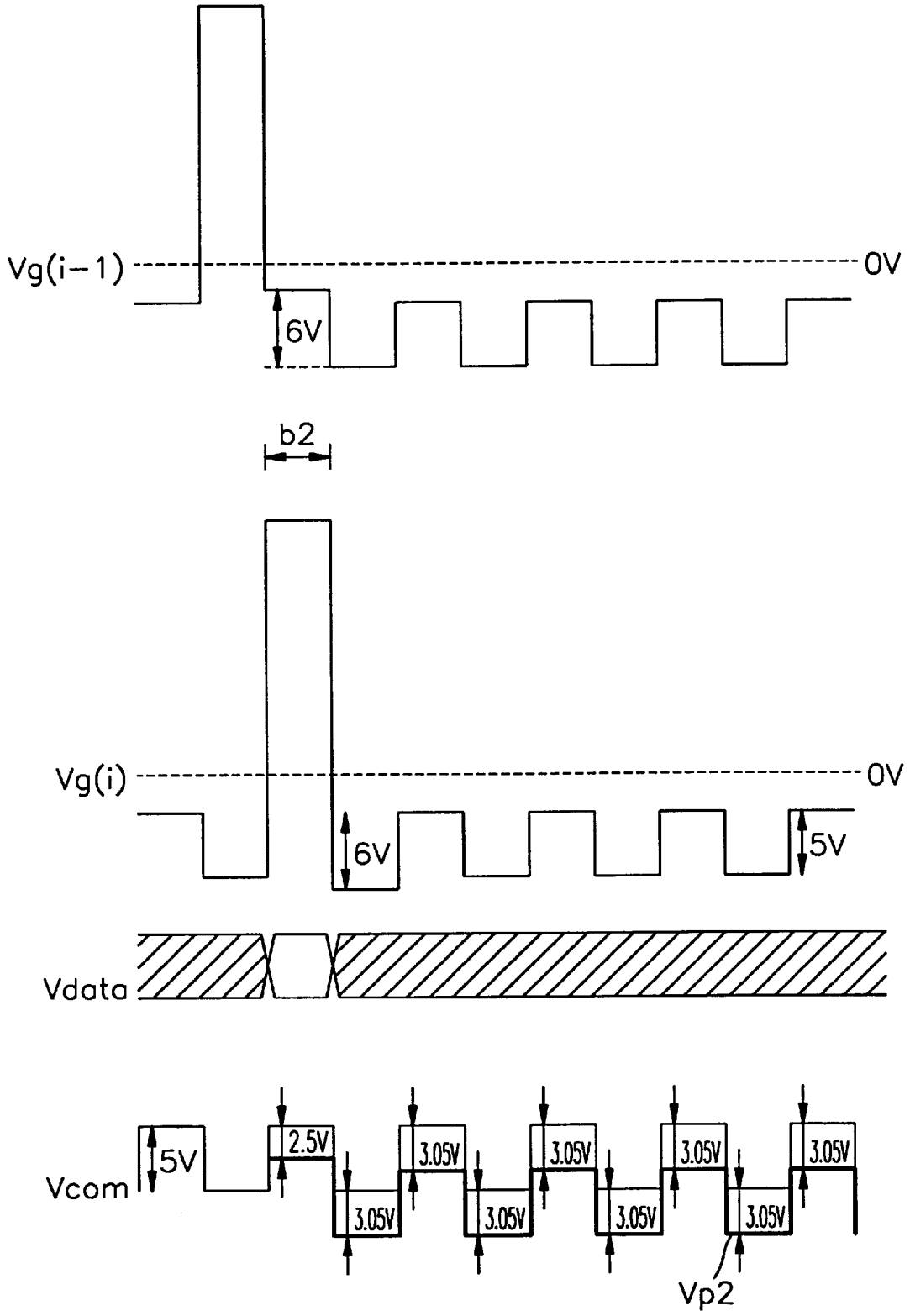

Referring now to FIG. 15A, neighboring liquid crystal cells have one of two storage capacitors, and liquid crystal cells having different storage capacitances are alternately arranged in the vertical and horizontal directions as illustrated. Two liquid crystal cells having different storage capacitors adjacent to each other in the horizontal direction are driven by different data lines and two liquid crystal cells having different storage capacitors adjacent to each other in the vertical direction are driven by different gate lines. FIGS. 15B and 15C illustrate the waveforms of the signals according to a second method embodiment of the present invention, which are applied to the device shown in FIG. 15A. FIG. 15B shows the signals applied to a liquid crystal cell 401 having the storage capacitor $C_{s1}$ and FIG. 15C shows the signals applied to a liquid crystal cell 402 having the storage capacitor $C_{s2}$.

Referring to FIG. 15B, a gate voltage Vg(i−2) is applied as a control voltage Vs to the storage capacitor in the liquid crystal cell 401 and is applied as a turn-on voltage Von during selection period of the upper gate line Gi−2. The gate voltage Vg(i−2) is deeply swung such as swung by 6V during the first horizontal interval "b1" of the non-selection period of the upper gate line Gi−2 and then is normally swung such as swung by 5V during the remaining portion of the non-selection period. Here, the gate voltage Vg(i−2) applied as the control voltage Vs of the liquid crystal cell 401 can be performed during at least one horizontal interval of the non-selection period instead of the first horizontal interval of the non-selection period of the upper gate line Gi−2. For example, any one of the second, third, . . . horizontal intervals of the non-selection period can be selected for the deep swing of the gate voltage.

Here, the interval "b1" denotes a selection period of the liquid crystal cell 401. The deep swing interval for the gate voltage Vg(i−2) is the same as the selection period of the liquid crystal cell 401, and the data voltage Vdata for data to be displayed in the liquid crystal cell 401 is applied during the interval "b2". Referring now to FIG. 15C, the gate voltage Vg(i−1) is applied to the other end of the storage capacitor as a control voltage Vs of the liquid crystal cell 402. The gate voltage Vg(i−1) is a turn-on voltage Von during the selection period of the gate line Gi−1 of the liquid crystal cell 401, and is deeply swung (such as swung by 6V) during the first horizontal interval "b2" of the non-selection period of the gate line Gi−1. Then, during the remaining portion of the non-selection period, the gate voltage Vg(i−1) is normally swung such as swung by 5V. Here, the deep swing of a gate voltage Vg(i−1) (which is a control voltage Vs of the liquid crystal cell 402) can be performed during one or more horizontal intervals of the nonselection period instead of during the first horizontal interval of the non-selection period. The interval "b2" denotes the selection period of the liquid crystal cell 402. The deep swing interval of the gate voltage Vg(i−1) is the same as the selection period of the liquid crystal cell 402, and the data voltage Vdata for data to be displayed in the liquid crystal cell 402 is applied during the interval "b2".

Since two neighboring liquid crystal cells have different storage capacitors as shown in FIG. 15A, during the non-selection periods the pixel electrode voltage Vp1 related to the storage capacitor $C_{s1}$ is different from the pixel electrode voltage Vp2 related to the storage capacitor $C_{s2}$. When $C_{s1}$ is 0.4 pF, $C_{LC}$ is 0.5 pF and $C_{s2}$ is 0.6 pF and the liquid crystal cells are each applied with a liquid crystal voltage whose absolute value is 2.5V during the selection period, the absolute values of the effective voltages appearing across the liquid crystal capacitors ($V_{LC}$) during the non-selection periods are 2.95V and 3.05V as expressed in the following formulas, to thereby generate a voltage difference of 0.1V between the two adjacent liquid crystal cells.

$$\begin{aligned} Q_{cell\text{-}401} &= C_{LC}(Vdata - Vcom) + C_{S1}(Vdata - V_{s(on)}) \\ &= 0.5\,\text{pF}(2.5\,\text{V} - 0\,\text{V}) + 0.4\,\text{pF}(2.5\,\text{V} - (-3\,\text{V} - 6\,\text{V})) \\ &= 5.85\,\text{pfV} \end{aligned}$$

$$\begin{aligned} Q_{cell\text{-}402} &= C_{LC}(Vdata - Vcom) + C_{S2}(Vdata - V_{s(on)}) \\ &= 0.5\ \text{pF}(2.5\,\text{V} - 5\,\text{V}) + 0.6\,\text{pF}(2.5\,\text{V} - (-8\,\text{V} + 6\,\text{V})) \\ &= 1.45\,\text{pfV} \end{aligned}$$

$$\begin{aligned} V_{LC(cell401)} &= Q_{cell\text{-}401} \big/ (C_{LC} + C_{S1}) + (C_{LC}/(C_{LC} + C_{S1}) - 1)Vcom + (C_{S1}/(C_{LC} + C_{S1}))Vs \\ &= 5.85\,\text{pFV}/0.9\,\text{pF} + ((0.5\,\text{pF}/0.9\,\text{pF}) - 1)5\,\text{V} + (0.4\,\text{pF}/0.9\,\text{pF})(-3\,\text{V}) \\ &= 2.95 \end{aligned}$$

$$\begin{aligned} V_{LC(cell402)} &= Q_{cell\text{-}402} \big/ (C_{LC} + C_{S2}) + (C_{LC}/(C_{LC} + C_{S2}) - 1)Vcom + (C_{S2}/(C_{LC} + C_{S2}))Vs \\ &= 1.45\,\text{pFV}/1.1\,\text{pF} + ((0.5\,\text{pF}/1.1\,\text{pF}) - 1)0\,\text{V} + (0.6\,\text{pF}/1.1\,\text{pF})(-8\,\text{V}) \\ &= -3.05 \end{aligned}$$

As described above, the absolute values of the effective voltages applied to the neighboring liquid crystal cells are different from each other, so that the twist degree of the liquid crystal is different based on the difference in absolute values of the effective liquid crystal voltages. Accordingly, the transmittivities of light also differ and the display's viewing angle can therefore be improved.

Figure 16A:
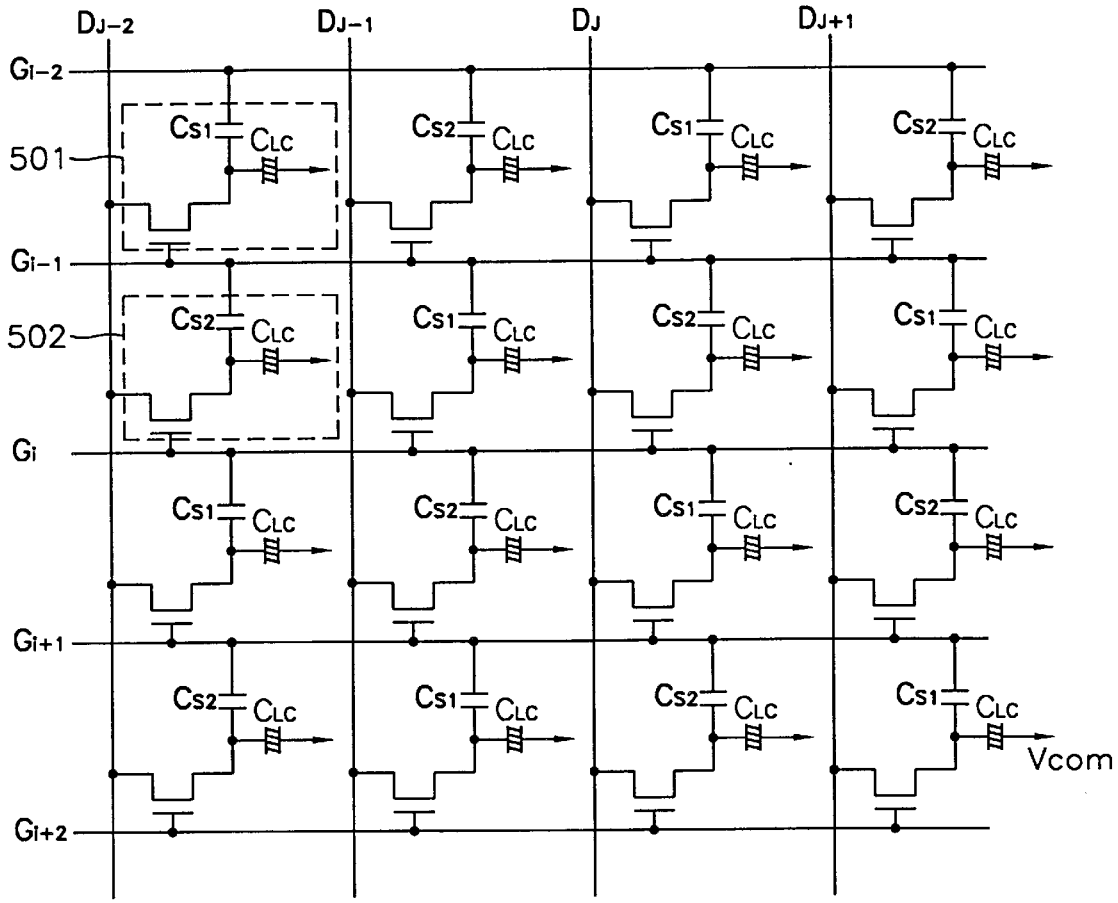
FIG. 16A illustrates a preferred liquid crystal display device according to a fourth embodiment of the present invention.
Figure 16B:
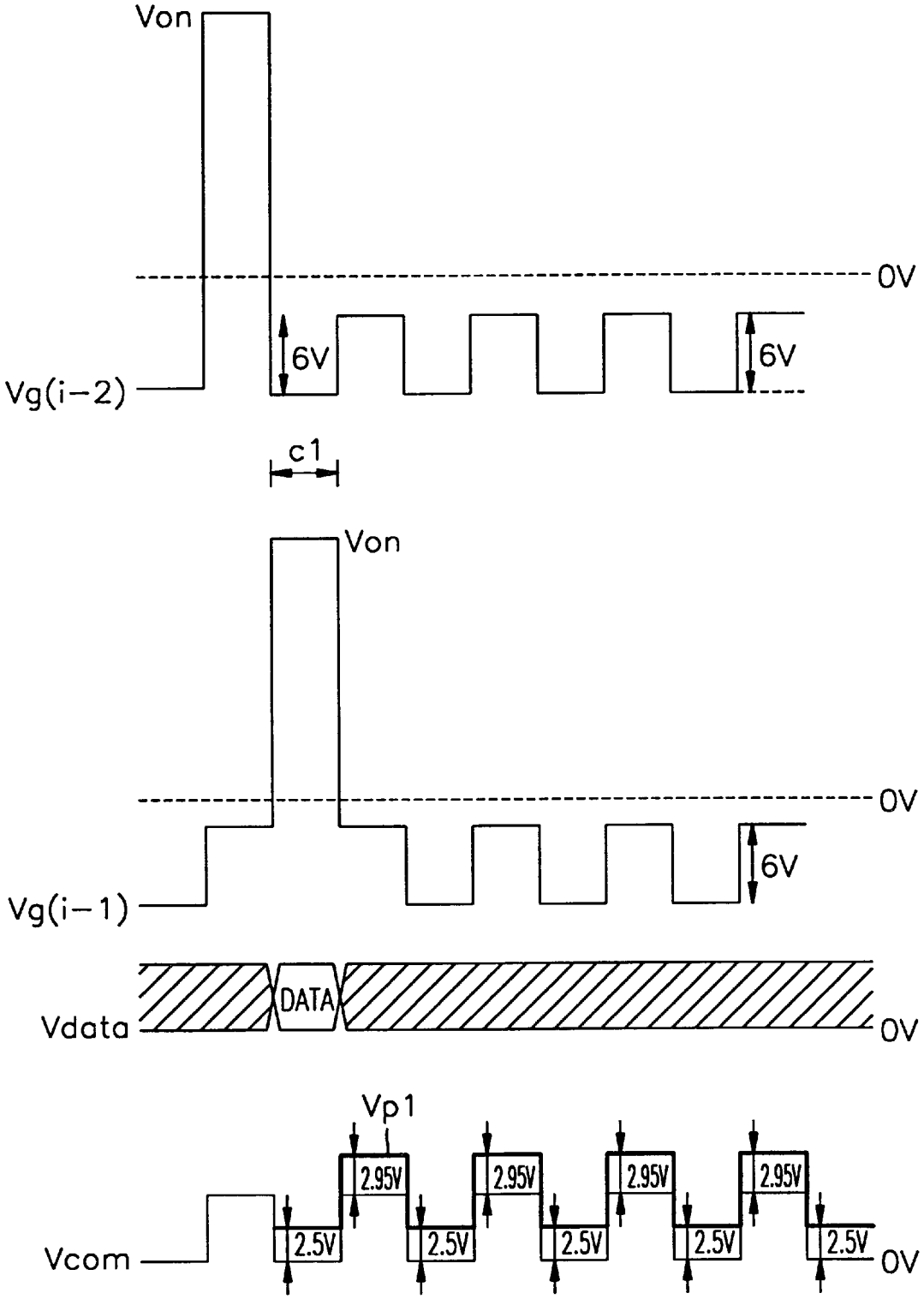
FIGS. 16B–16C are timing diagrams illustrating a method of driving the display device of FIG. 16A according to the present invention.
Figure 16C:
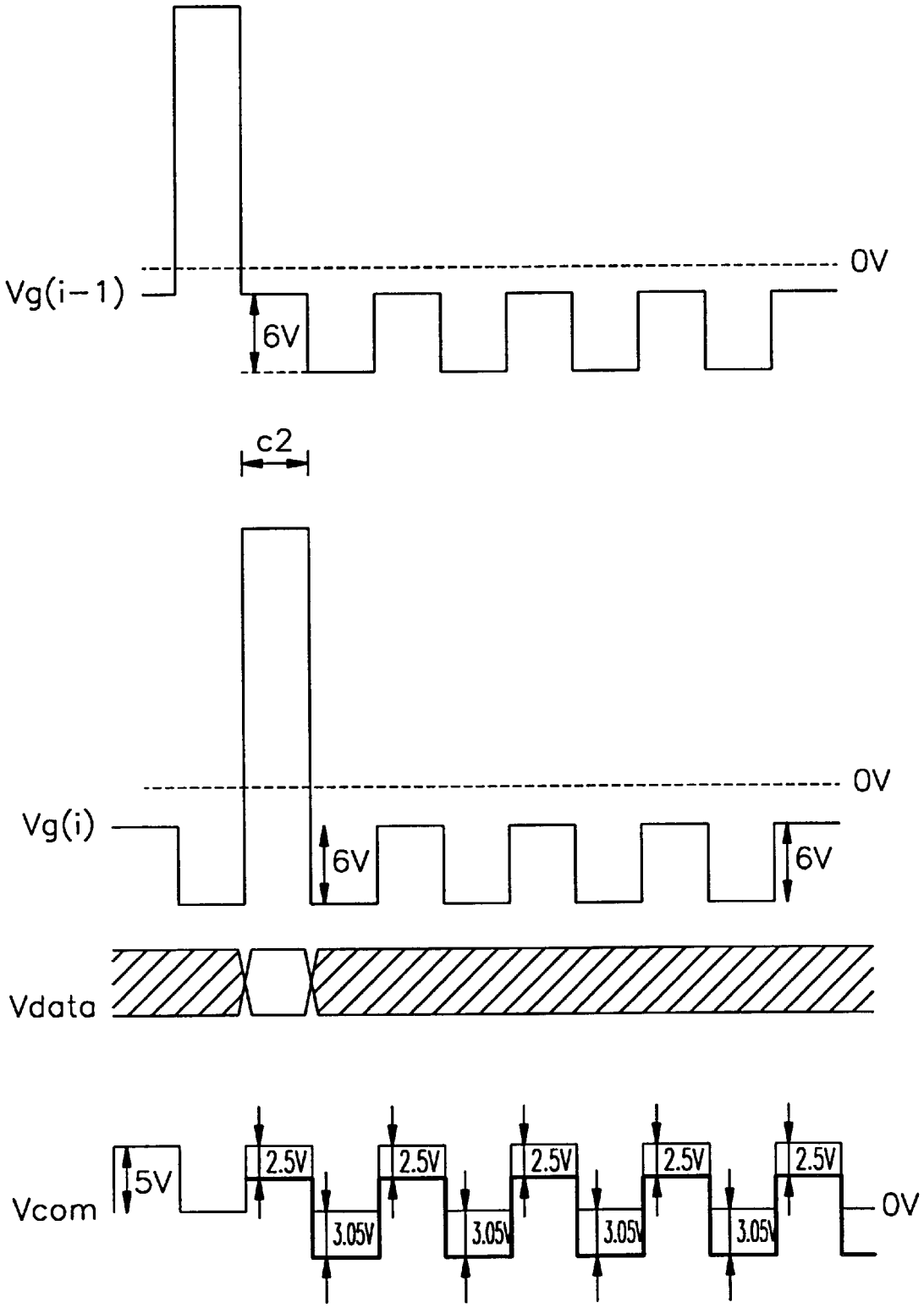

FIG. 16A shows a TFT liquid crystal display device to which the third embodiment of a driving method of the present invention can be applied, and FIG. 16B and 16C are the waveforms of the driving method according to the third embodiment of the present invention. Referring to FIG. 16A, a plurality of liquid crystal cells are arranged as a two-dimensional array. Two neighboring liquid crystal cells in the vertical direction have different storage capacitors $C_{s1}$ and $C_{s2}$ respectively and two neighboring liquid crystal cells in the horizontal direction have different storage capacitors $C_{s1}$ and $C_{s2}$, respectively. The storage capacitors $C_{s1}$ and $C_{s2}$ each have one end connected to the corresponding TFT and the other end connected to the upper neighboring gate line. FIG. 16B shows waveforms of signals applied to a liquid crystal cell 501 of FIG. 16A, and FIG. 16C shows waveforms of signals applied to a liquid crystal cell 502 of FIG. 16A. In FIG. 16B, a gate voltage Vg(i–2) as a control voltage Vs is applied to the other end of a storage capacitor of the liquid crystal cell 501, and is a turn-on voltage Von during a selection period of the gate line Gi–2, and is a swing voltage of 6V alternately changed between –3V and –9V in every horizontal interval during the non-selection period. A gate voltage Vg(i–1) which is a voltage applied to a gate of TFT of the liquid crystal cell 501 becomes a turn-on voltage Von during the selection period "c1" of the corresponding liquid crystal cell 501 and is a swing voltage of 6V alternately changed between –2V and –8V in every horizontal interval in the non-selection period of the corresponding liquid crystal cell 501. The data voltage Vdata related to the liquid crystal cell 501 is applied during the period "c1."

In FIG. 16C, the gate voltage Vg(i–1) as a control voltage Vs is applied to the other end of the storage capacitor of the liquid crystal cell 502, is a turn-on voltage Von during a selection period of the gate line Gi–1 and is a swing voltage of 6V alternately changed between –2V and –8V in every horizontal interval during a non-selection period. The gate voltage Vg(i) which is a voltage applied to a gate of the TFT of the liquid crystal cell 502 is a turn-on voltage Von during a selection period "c2" of the corresponding liquid crystal cell 502, and is a swing voltage of 6V alternately changed between –3V and –9V in every horizontal interval in the non-selection period of the liquid crystal cell 502. The data voltage Vdata related to the liquid crystal cell 502 is applied during the interval "c2".

Since two neighboring liquid crystal cells have different storage capacitors as shown in FIG. 16A, the pixel electrode voltages Vp1 and Vp2 are different from each other during the nonselection intervals. For example, when $C_{s1}$ is 0.4 pF, $C_{LC}$ is 0.5 pF, $C_{s2}$ is 0.6 pF, and the liquid crystal cells are applied with the voltage of 2.5V during the selection period, the liquid crystal cell related to storage capacitor $C_{s1}$ is alternatively applied with the voltages of 2.5V and 2.95V during the non-selection period (see FIG. 16B) and the liquid crystal cell related to storage capacitor $C_{s2}$ is alternatively applied with the voltages of 2.5V and 3.05V during the non-selection period (see FIG. 16C). Thus, the effective voltages applied across the liquid crystal capacitors of cells 501 and 502 are 2.79V and 2.73V, respectively. This can be expressed by following formulas:

$$Q_{cell\text{-}501} = C_{LC}(Vdata - Vcom) + C_{S1}(Vdata - V_{s(on)})$$
$$= 0.5\,\text{pF}(2.5\,\text{V} - 0\,\text{V}) + 0.4\,\text{pF}(2.5\,\text{V} - (-3\,\text{V} - 6\,\text{V}))$$
$$= 5.85\,\text{pfV}$$

$$Q_{cell\text{-}502} = C_{LC}(Vdata - Vcom) + C_{S2}(Vdata - V_{s(on)})$$
$$= 0.5\,\text{pF}(2.5\,\text{V} - 5\,\text{V}) + 0.6\,\text{pF}(2.5\,\text{V} - (-8\,\text{V} + 6\,\text{V}))$$
$$= 1.45\,\text{pfV}$$

$$V_{LC(cell\,501)}(\text{up swing}) = Q_{cell\text{-}501} / (C_{LC} + C_{S1}) + (C_{LC} / (C_{LC} + C_{S1}) - 1)Vcom + (C_{S1} / (C_{LC} + C_{S1}))Vs$$
$$= 5.85\,\text{pFV} / 0.9\,\text{pF} + ((0.5\,\text{pF} / 0.9\,\text{pF}) - 1)5\,\text{V} + (0.4\,\text{pF} / 0.9\,\text{pF})(-3\,\text{V})$$
$$= 2.95$$

$$V_{LC(cell\,501)}(\text{down swing}) = Q_{cell\text{-}501} / (C_{LC} + C_{S1}) + (C_{LC} / (C_{LC} + C_{S1}) - 1)Vcom + (C_{S1} / (C_{LC} + C_{S1}))Vs$$
$$= 5.85\,\text{pFV} / 0.9\,\text{pF} + ((0.5\,\text{pF} / 0.9\,\text{pF}) - 1)0\,\text{V} + (0.4\,\text{pF} / 0.9\,\text{pF})(-9\,\text{V})$$
$$= 2.5$$

$$V_{LC(cell\,502)}(\text{down swing}) = Q_{cell\text{-}502} / (C_{LC} + C_{S2}) + (C_{LC} / (C_{LC} + C_{S2}) - 1)Vcom + (C_{S2} / (C_{LC} + C_{S2}))Vs$$
$$= 1.45\,\text{pFV} / 1.1\,\text{pF} + ((0.5\,\text{pF} / 1.1\,\text{pF}) - 1)0\,\text{V} + (0.6\,\text{pF} / 1.1\,\text{pF})(-8\,\text{V})$$
$$= -3.05$$

$$V_{LC(cell\,502)}(\text{up swing}) = Q_{cell\text{-}502} / (C_{LC} + C_{S2}) + (C_{LC} / (C_{LC} + C_{S2}) - 1)Vcom + (C_{S2} / (C_{LC} + C_{S2}))Vs$$
$$= 1.45\,\text{pFV} / 1.1\,\text{pF} + ((0.5\,\text{pF} / 1.1\,\text{pF}) - 1)5\,\text{V} + (0.6\,\text{pF} / 1.1\,\text{pF})(-2\,\text{V})$$
$$= -2.5$$

Figure 1:
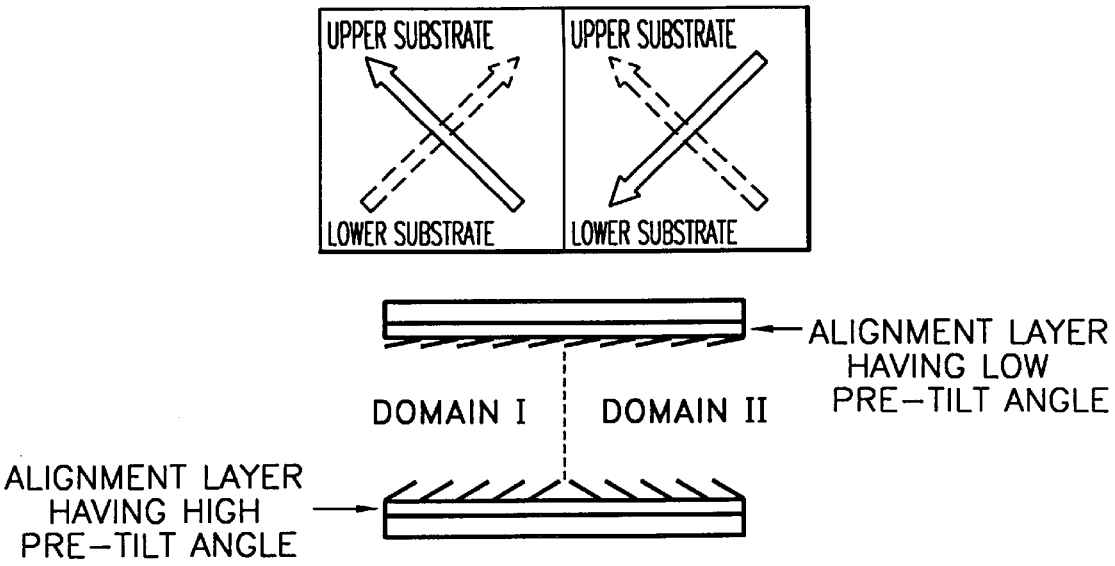
FIG. 1 (PRIOR ART)
FIGS. 1–3 show various conventional multi-domain liquid crystal cells.
Figure 2:
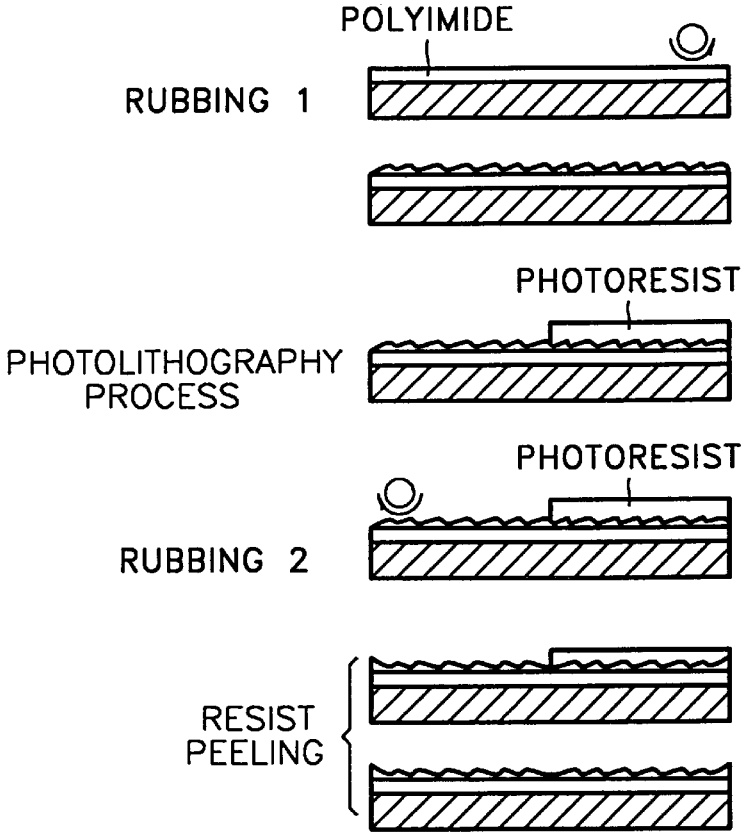
FIG. 2 (PRIOR ART)
Figure 3:
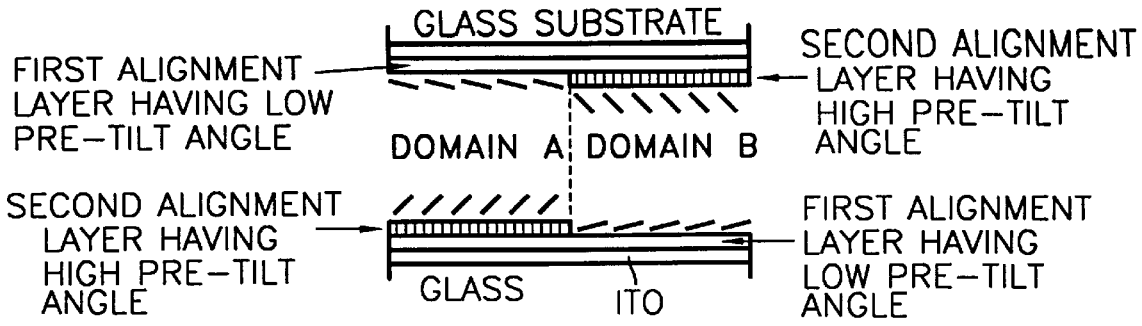
FIG. 3 (PRIOR ART)
Figure 4A:
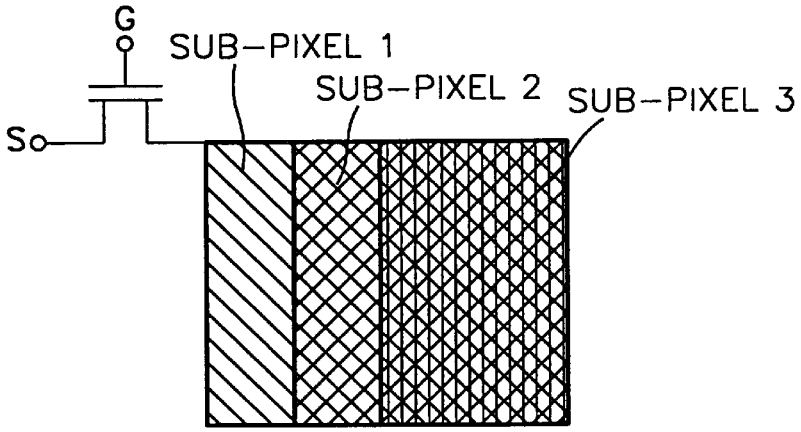
FIG. 4A (PRIOR ART)
FIGS. 4A, 4B and 5 show liquid crystal cell structures having subpixels, an equivalent circuit thereof and a cross sectional view thereof, respectively.
Figure 4B:
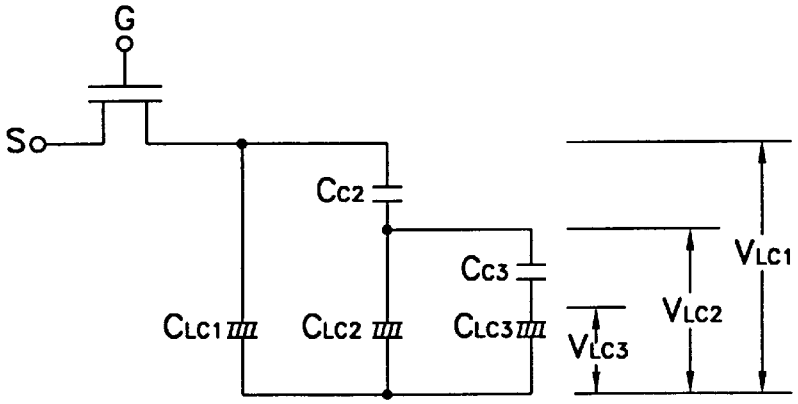
FIG. 4B (PRIOR ART)
Figure 5:
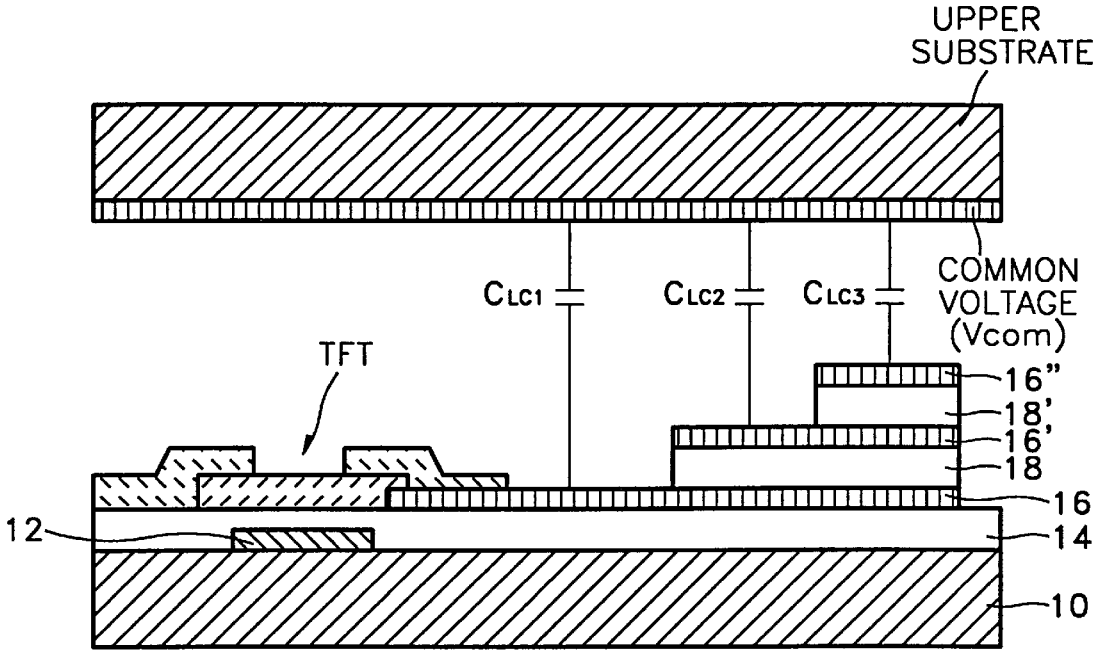
FIG. 5 (PRIOR ART)

Accordingly, the twist degrees of two neighboring liquid crystal cells are different based on the differences of the effective voltages appearing across the liquid crystal capacitors. Thus, the driving method shown in FIGS. 16B and 16C can improve the maximum viewing of a LCD display device. As a result, the driving method shown in FIG. 16B and FIG. 16C, which describe the operation of the liquid crystal display shown in FIG. 16A, can obtain the same net effect as that of TFT LCD shown in FIGS. 4A, 4B and 5.

Figure 17A:
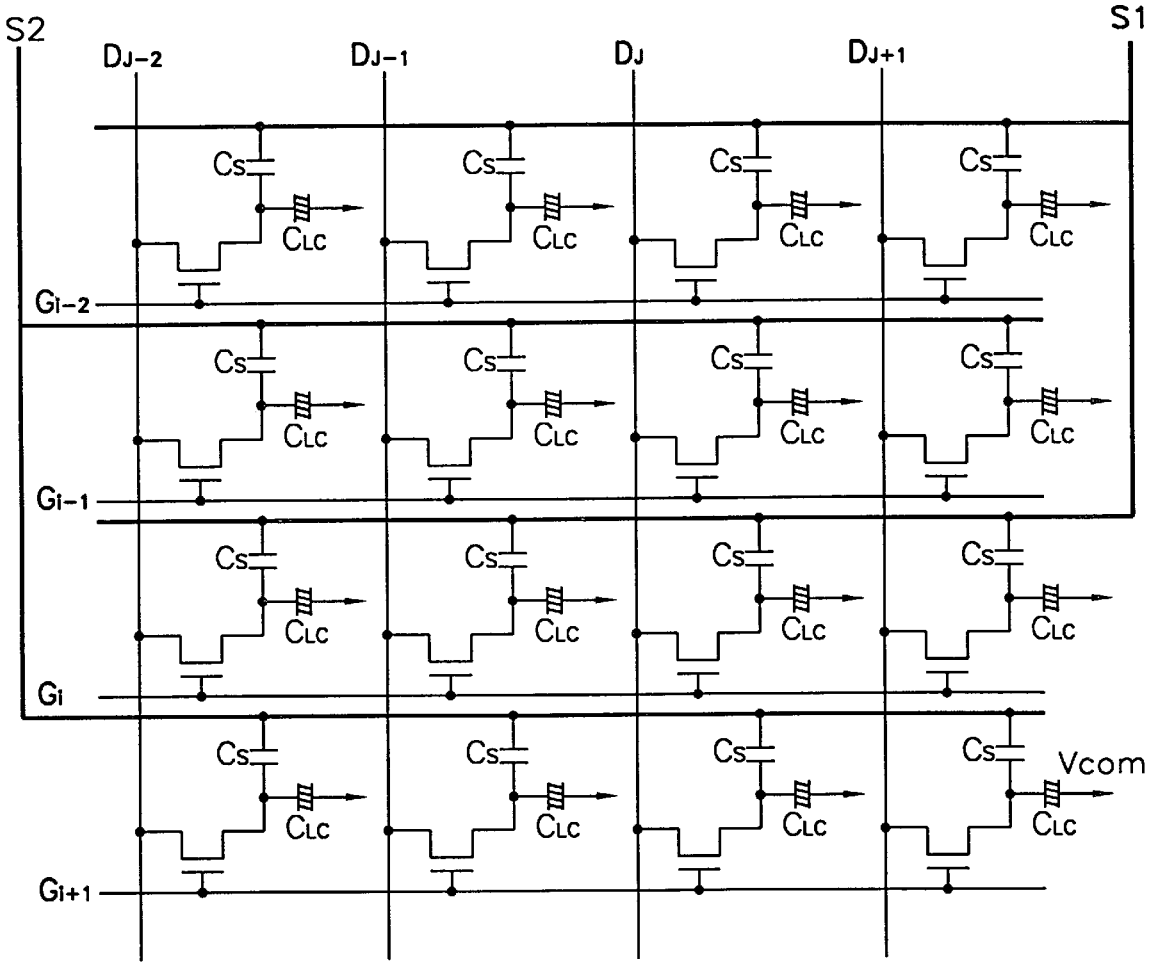
FIG. 17A illustrates a preferred liquid crystal display device according to a fifth embodiment of the present invention.
Figure 17C:
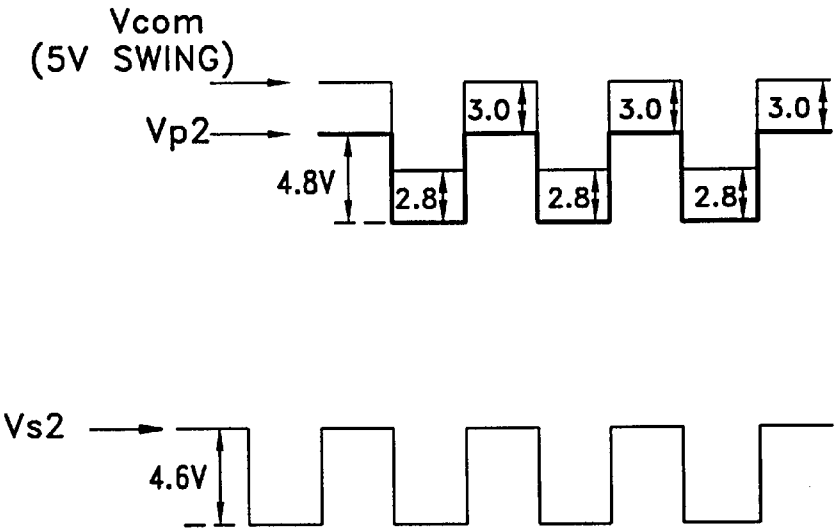
FIGS. 17B–17C are timing diagrams illustrating a method of driving the display device of FIG. 17A according to the present invention.
Figure 17B:
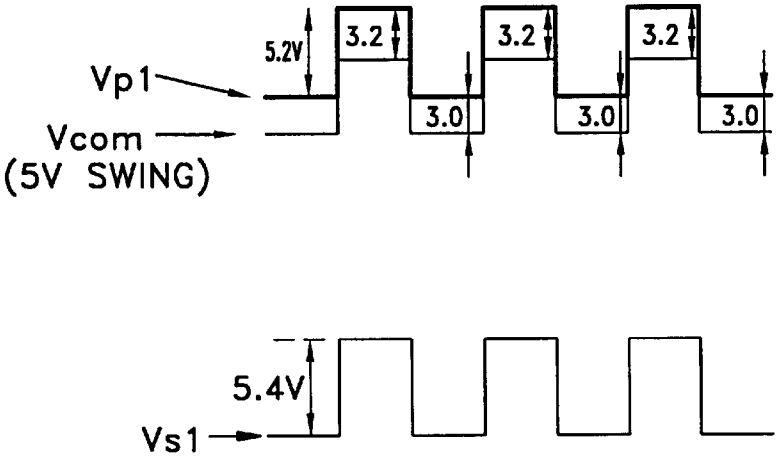

FIG. 17A shows a TFT LCD which can be operated in accordance with a fourth embodiment of a driving method of the present invention, and FIG. 17B and FIG. 17C are the waveforms illustrating the fourth embodiment of the driving method. Referring to FIG. 17A, a plurality of liquid crystal cells having a storage capacitor $C_s$ and a liquid crystal capacitor $C_{LC}$ are arranged in a matrix. In a TFT, a gate is connected to the corresponding gate line Gi−2, Gi−1, Gi and Gi+1 arranged in a row direction, a drain is connected to the corresponding data line Dj−2, Dj−1, Dj and Dj+1 arranged in column direction, and a source is connected to an pixel electrode constituting one side of the liquid crystal capacitor $C_{LC}$ and one side of the storage capacitor $C_s$. The other side of the liquid crystal capacitor $C_{LC}$ is applied with a common voltage Vcom. The storage capacitors are divided into two group such that two neighboring storage capacitors in the vertical direction should be included in different groups, respectively. Here, it is also possible that two neighboring storage capacitors in the horizontal direction should be included in different groups. Also, it is possible that neighboring storage capacitors in both vertical and horizontal directions should be included in different groups. Then, one group of storage capacitors are commonly connected to a first control line S1 and the other group of storage capacitors are commonly connected to a second control line S2.

Referring to FIGS. 17B and 17C, the first control voltage Vs1 applied to the first control line S1 is swung by 5.4V and the second control voltage Vs2 applied to the second control line S2 is swung by 4.6V. The difference between the control voltages causes a difference between the charges accumulated during the selection period and also causes a difference between the pixel electrode voltages during the non-selection period, so that the liquid crystal voltages are different.

For example, when $C_s$ is 0.5 pF, $C_{LC}$ is 0.5 pF, and the liquid crystal cells are applied with the voltage of 3.0V during the selection period, the pixel electrode coupled through corresponding storage capacitor to the first control line S1 shows the pixel voltage Vp1 swung by 5.2V (see FIG. 17B) and the pixel electrode coupled through the corresponding storage capacitor to the second control line S2 has the pixel voltage Vp2 swung by 4.8V (see FIG. 17C). Accordingly, the effective voltages (or root mean square voltage) applied to the liquid crystal cells related to the first and second groups are 3.1V and 2.9V respectively, to generate a voltage difference of 0.2V. The twist degrees of the two liquid crystal cells included in different groups are different according to the effective voltages which means the transmittivities of the cells in the different groups are different. Thus, the driving method shown in FIGS. 17B and 17C can diminish the sensitivity to the viewing angle.

As described above, according to a method for driving a TFT LCD of the present invention, in order for the variation of transmittivity to occur, the variation in the effective voltage applied to the liquid crystals is controlled by the voltage applied to the storage capacitors. In more detail, the voltages applied to the storage capacitors are routed through the upper neighboring gate lines (or separate control line). This driving method is easily implemented because the applied voltage to the storage capacitor can be controlled irrespective of the data to be displayed. That is, the variation of transmittivity can be implemented irrespective of the data to be displayed. Thus, the peripheral circuit needed to perform the driving method is simplified. Also, this driving method can compensate for the difference in the electrical-optical transfer characteristics of the TFT LCD due to the fabrication thereof, by the control of the voltage applied to the storage capacitor. This improves the image quality to be displayed by the TFT LCD.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A method of operating a liquid crystal display device having first and second display cells in first and second rows therein, respectively, said method comprising the steps of:

loading first data from a first data line onto a first pixel electrode in the first display cell during a first selection time interval, while simultaneously driving a first electrode of a first storage capacitor in the first display cell with a first signal so that the loaded first data is represented as a first voltage across a first liquid crystal capacitor in the first display cell during a first non-selection time interval which follows the first selection time interval; and loading the first data from the first data line onto a second pixel electrode in the second display cell during a second selection time interval, while simultaneously driving a first electrode of a second storage capacitor in the second display cell with a second signal so that the loaded first data is represented as a second voltage, unequal in magnitude to the first voltage, across a second liquid crystal capacitor in the second display cell during a second non-selection time interval which follows the second selection time interval.

2. The method of claim 1, wherein a magnitude of a potential of the first signal during the first selection time interval is unequal to a magnitude of a potential of the second signal during the second selection time interval.

3. The method of claim 2, wherein the second selection time interval commences upon termination of the first selection time interval.

4. The method of claim 1, wherein a capacitance of the first storage capacitor is unequal to a capacitance of the second storage capacitor.

5. The method of claim 4, wherein a magnitude of a potential of the first signal during the first selection time interval is equal to a magnitude of a potential of the second signal during the second selection time interval.

6. The method of claim 5, wherein the first electrode of the second storage capacitor is electrically connected to a gate electrode of a thin-film transistor in the first display cell.

7. The method of claim 3, wherein the first electrode of the second storage capacitor is electrically connected to a gate electrode of a thin-film transistor in the first display cell.

8. The method of claim 5, wherein the second selection time interval commences upon termination of the first selection time interval.

9. The method of claim 6, wherein a capacitance of the first liquid crystal capacitor equals a capacitance of the second liquid crystal capacitor.

10. The method of claim 7, wherein a capacitance of the first liquid crystal capacitor equals a capacitance of the second liquid crystal capacitor.

11. The method of claim 7, wherein the first non-selection time interval overlaps the second selection time interval; and wherein the second non-selection time interval commences upon termination of the second selection time interval.

12. A method of operating a liquid crystal display device having first and second display cells in first and second rows therein, respectively, said method comprising the steps of:

loading first data from a first data line onto a first pixel electrode in the first display cell during a first selection time interval, while simultaneously driving a first electrode of a first storage capacitor in the first display cell with a first signal so that the loaded first data on the first pixel electrode is represented as a first waveform during a first plurality of non-selection time intervals which follow the first selection time interval, said first waveform having a first average voltage; and loading the first data from the first data line onto a second pixel electrode in the second display cell during a second selection time interval, while simultaneously driving a first electrode of a second storage capacitor in the second display cell with a second signal so that the loaded first data on the second pixel electrode is represented as a second waveform during a second plurality of non-selection time intervals which follow the second selection time interval, said second waveform having a second average voltage which is unequal in magnitude to the first average voltage.

13. The method of claim 12, wherein a magnitude of a potential of the first signal during the first selection time interval is unequal to a magnitude of a potential of the second signal during the second selection time interval.

14. The method of claim 13, wherein the second selection time interval commences upon termination of the first selection time interval.

15. The method of claim 12, wherein a capacitance of the first storage capacitor is unequal to a capacitance of the second storage capacitor.

16. The method of claim 15, wherein a magnitude of a potential of the first signal during the first selection time interval is equal to a magnitude of a potential of the second signal during the second selection time interval.

17. The method of claim 16, wherein the first electrode of the second storage capacitor is electrically connected to a gate electrode of a thin-film transistor in the first display cell.

18. The method of claim 14, wherein the first electrode of the second storage capacitor is electrically connected to a gate electrode of a thin-film transistor in the first display cell.

19. The method of claim 16, wherein the second selection time interval commences upon termination of the first selection time interval.

* * * * *